US006695697B1

(12) United States Patent
Okada

(10) Patent No.: US 6,695,697 B1
(45) Date of Patent: Feb. 24, 2004

(54) GAME DEVICE AND MEDIUM MEMORIZING A GAME PROGRAM AND READABLE BY A COMPUTER FOR SUPPORT PLAYERS' TECHNICAL INTERVENTION WITHOUT CHANGING FUNDEMENTAL SPECIFICATION OF THE GAME DEVICE

(75) Inventor: Kazuo Okada, Tokyo (JP)

(73) Assignee: Aruze Co., Ltd., Tokyo (JP)

( * ) Notice: Subject to any disclaimer, the term of this patent is extended or adjusted under 35 U.S.C. 154(b) by 223 days.

(21) Appl. No.: 09/830,569

(22) PCT Filed: Sep. 6, 2000

(86) PCT No.: PCT/JP00/06071

§ 371 (c)(1),
(2), (4) Date: May 8, 2001

(87) PCT Pub. No.: WO01/19471

PCT Pub. Date: Mar. 22, 2001

(30) Foreign Application Priority Data

Sep. 10, 1999 (JP) ..... 11-256654
Sep. 17, 1999 (JP) ..... 11-263117
Jul. 7, 2000 (JP) ..... 2000-211967

(51) Int. Cl.[7] ..... A63F 9/24
(52) U.S. Cl. ..... 463/20; 273/143 R
(58) Field of Search ..... 463/1, 13, 16, 463/18, 20, 21, 22, 25, 26, 27, 30, 43; 273/143 R, 139, 142 R

(56) References Cited

U.S. PATENT DOCUMENTS 5,630,753 A * 5/1997 Fuchs ..... 463/9
5,989,121 A * 11/1999 Sakamoto ..... 463/20
6,270,409 B1 * 8/2001 Shuster ..... 463/20

FOREIGN PATENT DOCUMENTS

JP 8-24401 A 1/1996
JP 08-024401 * 1/1996 ..... A63F/5/04
JP 11-178991 A 7/1999
JP 11-178991 * 7/1999 ..... A63F/5/04
JP 2000-140209 A 5/2000

* cited by examiner

*Primary Examiner*—Kim Nguyen
(74) *Attorney, Agent, or Firm*—Bacon & Thomas, PLLC

(57) ABSTRACT

A game machine and a medium storing a game program and readable by a computer, provides support corresponding to players' technical levels and individual players, showing an excellent navigation function, without perverted equality between beginners and advanced players and only nominal support, not like the case of uniformly applying the support functions. Players technical levels are qualified into beginners, middle-grade or advanced on the basis of a latest games history such as the number of games spent under Bonus internally determined, or points values recorded in membership cards, and actuation of the support is allowed on the basis of the qualified technical level. As a result, when the number of games spent under Bonus internally determined is over a predetermined value, setting an aiming marker is allowed. Wheel bands are shown beside simulated wheels; or result of internal winning determination are informed.

26 Claims, 35 Drawing Sheets

Fig. 4

List of winning combinations

| | | Left wheel 4L | Middle wheel 4C | Right wheel 4R | Wins |
|---|---|---|---|---|---|
| ① Big Bonus | "Red 7"-"Red 7"-"Red 7" | | | | 3 sets of Regular Bonuses. Ending after 3 sets of Regular Bonuses or 30 games. |
| | "Bird"-"Bird"-"Red 7" | | | | |
| ② Regular Bonus | "BAR"-"BAR"-"BAR" | BAR | BAR | BAR | 12 times of Jack Games. Ending after winning 8 times in Jack Games, or after 12 times of Jack Games. |
| | "Bird"-"Bird"-"BAR" | | | BAR | |
| ③ Bit of Wins | Main Bit "Feather"-"Feather"-"Feather" | | | | 10 tokens paid. 12 in Big Bonus. |
| | "Grape"-"Grape"-"Grape" | | | | 14 tokens paid |
| | "Feather"-"Feather"-"Bird" | | | | One token paid three in Big Bonus. |
| | "Cherry"-ANY-ANY | | ANY | ANY | 2 tokens paid |
| ④ Replay | "Replay"-"Replay"-"Replay" | AAA | AAA | AAA | Next game available, without use of token(s). Entering Regular Bonus in playing Big Bonus. |
| ⑤ Jack Game | "Red 7"-"Replay"-"Replay" | | AAA | AAA | 15 tokens paid |
| | "BAR"-"Replay"-"Replay" | BAR | AAA | AAA | |
| | "Replay"-"Replay"-"Replay" | AAA | AAA | AAA | |

Fig. 10(A)
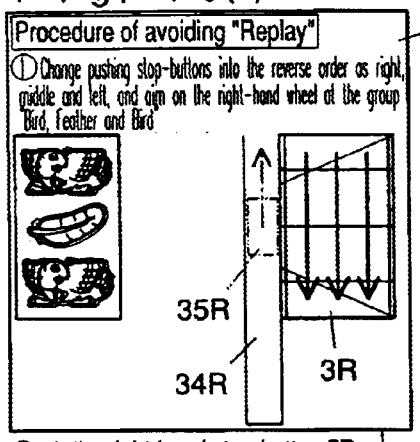
Push the right-hand stop-button 7R
Fig. 10(B)
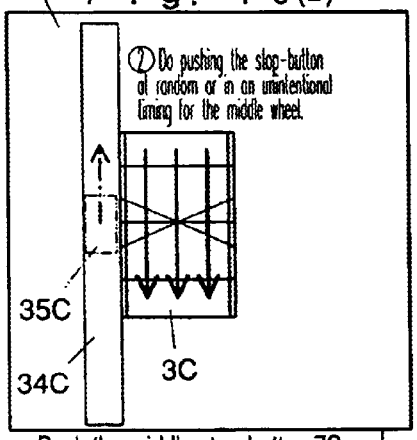
Push the middle stop-button 7C.
Fig. 10(C)
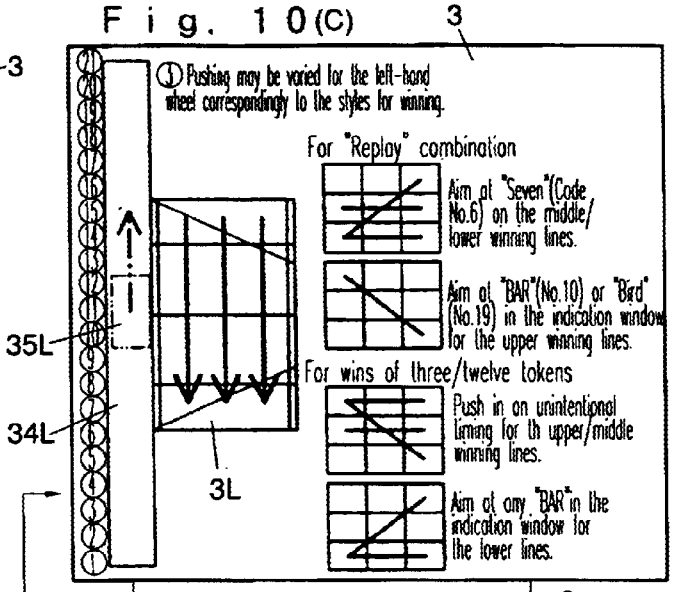
Push the left-hand stop-button 7L.
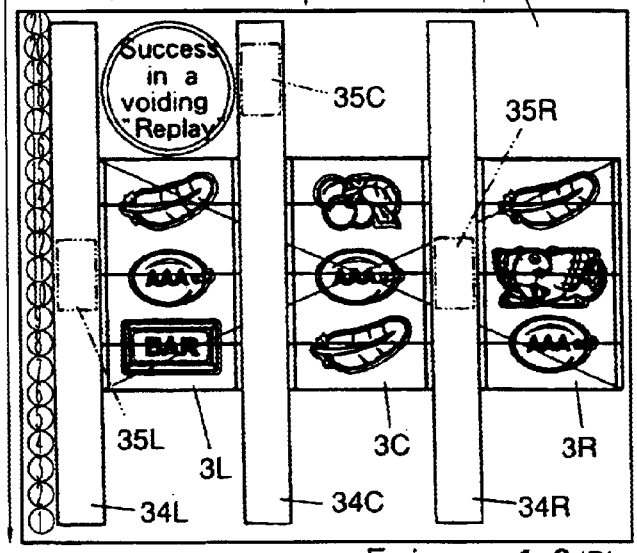
Fig. 10(D)
Fig. 10(E)
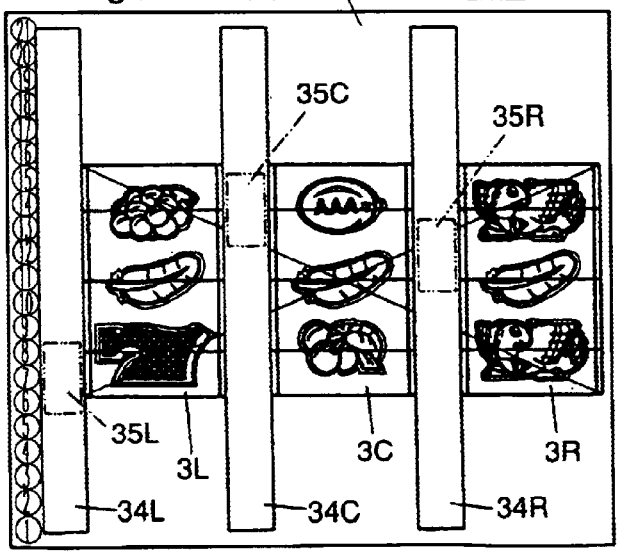

Fig. 12

List of various supporting functions

| Game aspects (stages) / Support means (manners of support) | In usual games (Ordinary games) | | With (under) Bonus internally determined | | In Big Bonus | |
|---|---|---|---|---|---|---|
| | Operation trigger (to watch) | Detail of support | Operation trigger (to watch) | Detail of support | Operation trigger (to watch) | Detail of support |
| Putting Aiming Markers | | | 15 games or more, 25 games or less after flagging | Marker setting allowed | less than 10 ordinary games remaining, Regular Bonus not yet won | Marker setting allowed |
| Wheels' bands indicated | Number of games after "Bonus" : 500 or more. | Wheels' bands shown | 9 games or less after flagging | None | In Big Bonus | Wheels' bands shown, and Indication windows scrolled. |
| | | | 10 or more, 30 or less after flagging | Wheels' bands shown | | |
| | | | 31 or more after flagging | Wheels' bands shown, and Indication windows scrolled | | |
| Internal determination results informed | Number of games after "Bonus" : 300 or less. | None | under 5 games after flagging | None | After end of 1st set Regelar Bonus | Entering Regular Bonus, "Replay" informed |
| | Number of games after "Bonus" : 301 or more, 600 or less. | Winning styles of two/four tokens informed | 5 or more, 15 or less after flagging | All of "Bit of Wins" informed | After end of 2nd set Regelar Bonus | All of winning styles informed |
| | Number of games after "Bonus" : 601 or more. | Winning styles of one/ten tokens informed | 16 or more after flagging | All of winning styles informed | | |
| Technique shown | | | | | 10 ordinary games or more, Net increment zero or less before initial Regular Bonus | Procedure for avoiding "Replay" shown. |
| Games results indicated | | | Upon winning "Bonus". | Games history between "Bonuses" shown | Upon end of Big Bonus | Games History in Bonus and Total Games History shown |

Table of relationship between technical levels and support elements with respect to specific support means Table of relationship between technical levels and support elements with respect to games aspects

Fig. 17

Table of correspondence between membership card records and points

| Items recorded | Specific values | Support means | Weighting by points | | | | |
|---|---|---|---|---|---|---|---|
| | | | for beginners, middle-grade | | | | for advanced |
| | | | Aiming markers | Wheels bands * | Internal winning determination results informed | Operating technique shown | Games results shown |
| Sexes | Men | 01 | 0 | 0 | 0 | 1 | 1 |
| | Women | 02 | 1 | 1 | 1 | 1 | 0 |
| Ages | 30 or less | 0~30 | 0 | 0 | 0 | 0 | 2 |
| | 31 or more, under 50 | 31~49 | 0 | 1 | 1 | 1 | 0 |
| | 50 or more | 50 or more | 1 | 2 | 2 | 3 | 0 |
| Residential area | within a radius of 3 kilometers of the area | 01 | 0 | 1 | 0 | 0 | 0 |
| | within a radius of 500 meters of the area | 02 | 1 | 2 | 1 | 0 | 0 |
| Days using the game | under 10 days | 0~9 | 0 | 0 | 0 | 0 | 0 |
| | 10 days or more, under 60days | 10~59 | 1 | 1 | 1 | 1 | 1 |
| | 60 or more | 60 or more | 2 | 3 | 2 | 2 | 2 |
| Total games | under 15000 | 0~14999 | 0 | 0 | 0 | 0 | 0 |
| | 15000 or more, under 30000 | 15000~29999 | 1 | 1 | 1 | 1 | 1 |
| | 30000 or more | 30000 or more | 2 | 2 | 2 | 2 | 2 |
| Total Big Bonuses achieved | under 30 | 0~29 | 0 | 0 | 0 | 0 | 0 |
| | 30 or more, under 60 | 30~59 | 0 | 0 | 0 | 0 | 1 |
| | 60 or more | 60 or more | 0 | 1 | 1 | 0 | 2 |
| Payout/use ratio | under 70% | 0~69 | 0 | 0 | 0 | 0 | −3 |
| | 70% or more, under 100% | 70~99 | −2 | −2 | −1 | −1 | 0 |
| | 100% or more | 100 or more | −3 | −3 | −2 | −2 | 3 |
| Average coin per Big Bonus | 350 or more | 0~350 | 2 | 2 | 2 | 3 | 0 |
| | 351 or more, under 400 | 351~399 | −1 | 0 | 1 | 1 | 1 |
| | 400 or more | 400 or more | −2 | −2 | −1 | −3 | 3 |
| | Points | | Pb | Pc | Pd | Pe | Pf |

* partially for the advanced players

Fig. 18

Table of correspondence between points and standard values

| Support means | Support elements | Reference points | Games aspects: in ordinary games | Games aspects: under Bonus internally determined | Games aspects: in ordinary games in Big Bonus |
|---|---|---|---|---|---|
| Aiming markers | Setting allowed | beginners / middle – grade Pb | 3 or more | 2 or more | 1 or more |
| Wheels bands | Wheels bands shown | middle – grade Pc | 4 or more | 3 or more | 6 or more |
| | Wheels bands shown and indication windows (designs) shown | beginners Pc | 6 or more | 4 or more | 7 or more |
| | Wheels bands shown and stop – operation shown | advanced Pc | 2 or less | 2 or less | 3 or less |
| Internal winning determination results informed | Bit of Wins | middle – grade Pd | 5 or more | 5 or more | 1 or more |
| | Replay | middle – grade Pd | 5 or more | 5 or more | 2 or more |
| | Bonus | beginners Pd | 8 or more | 8 or more | |
| Operational technique shown | "Replay" avoiding technique shown | beginners / middle – grade Pe | | | 2 or more |
| Games Results shown | Tokens data | advanced Pf | | 3 or more | |
| | List of Bonuses | advanced Pf | | 4 or more | |
| | Bit of Wins data | advanced Pf | 5 or more | | |
| | Graph of "Failure" (in Big Bonus) | advanced Pf | 5 or more | | |
| | Graph of "Failure" (in ordinary games) | advanced Pf | 8 or more | | |
| | List of flash patterns | advanced Pf | 10 or more | | |

Table of relationship between technical levels and support elements with respect to specific support means Table of relationship between technical levels and support elements with respect to games aspects Scene standing by 3 Image display device Scene started after token (s) used 3 Image display device

Fig. 34

Table of points addition for specific levels

| Levels | Differentiation | Internal determination flagging (winning styles) | | | | | | |
|---|---|---|---|---|---|---|---|---|
| | | Grape | Feather – Feather – Bird | Feather – Feather – Feather | 4 tokens Cherry | 2 tokens Cherry | B B | R B |
| 1 | winning | + 10 | + 7 | 0 | + 4 | + 2 | — | — |
| | failure | − 1 | − 1 | 0 | − 1 | 0 | — | — |
| 2 | winning | 0 | + 10 | 0 | + 2 | 0 | — | — |
| | failure | − 1 | − 2 | 0 | − 1 | − 1 | — | — |
| 3 | winning | + 3 | + 3 | 0 | + 2 | + 1 | — | — |
| | failure | − 3 | − 3 | 0 | − 2 | − 1 | − 10 | — |
| 4 | winning | + 1 | 0 | 0 | 0 | 0 | — | — |
| | failure | − 4 | − 3 | 0 | − 3 | − 3 | − 30 | − 25 |

Fig. 35

Table of level setting

| Levels | Point (s) |
|---|---|
| 1 | 50 or less |
| 2 | 51 to 100 |
| 3 | 101 to 150 |
| 4 | 151 or more |

Table for selection of the informing features for specific levels

| Levels | Informing features | | Internal determination flagging (winning styles) | | | | | | |
|---|---|---|---|---|---|---|---|---|---|
| | Bearer | Items (*) | Grape | Feather – Feather – Bird | Feather – Feather – Feather | Two/Four tokens Cherry | B B | R B | blank |
| 1 | Large | A | 128 | 0 | 0 | 0 | 0 | 0 | 0 |
| | | B | 0 | 128 | 0 | 0 | 0 | 0 | 0 |
| | | C | 0 | 0 | 128 | 0 | 0 | 0 | 0 |
| | | D | 0 | 0 | 0 | 128 | 0 | 0 | 0 |
| | | E | 0 | 0 | 0 | 0 | 0 | 0 | 0 |
| | | F | 0 | 0 | 0 | 0 | 0 | 0 | 0 |
| | | None | 0 | 0 | 0 | 0 | 128 | 128 | 128 |
| 2 | M dium | A | 80 | 5 | 2 | 5 | 3 | 2 | 9 |
| | | B | 10 | 90 | 5 | 1 | 2 | 1 | 5 |
| | | C | 5 | 2 | 90 | 3 | 10 | 1 | 7 |
| | | D | 20 | 1 | 3 | 110 | 1 | 3 | 11 |
| | | E | 1 | 0 | 15 | 1 | 111 | 101 | 2 |
| | | F | 12 | 30 | 13 | 8 | 1 | 20 | 13 |
| | | None | 0 | 0 | 0 | 0 | 0 | 0 | 81 |
| 3 | Small | A | 0 | 0 | 0 | 0 | 0 | 0 | 0 |
| | | B | 0 | 0 | 0 | 0 | 0 | 0 | 0 |
| | | C | 0 | 0 | 0 | 0 | 2 | 0 | 0 |
| | | D | 0 | 0 | 0 | 0 | 0 | 0 | 0 |
| | | E | 0 | 0 | 0 | 0 | 0 | 0 | 0 |
| | | F | 20 | 30 | 40 | 20 | 0 | 0 | 20 |
| | | None | 108 | 98 | 88 | 108 | 126 | 128 | 108 |
| 4 | None | A | 0 | 0 | 0 | 0 | 0 | 0 | 0 |
| | | B | 0 | 0 | 0 | 0 | 0 | 0 | 0 |
| | | C | 0 | 0 | 0 | 0 | 0 | 0 | 0 |
| | | D | 0 | 0 | 0 | 0 | 0 | 0 | 0 |
| | | E | 0 | 0 | 0 | 0 | 0 | 0 | 0 |
| | | F | 0 | 0 | 0 | 0 | 0 | 0 | 0 |
| | | None | 128 | 128 | 128 | 128 | 128 | 128 | 128 |

(*)

Fig. 37(A) Bearer (large) Level 1
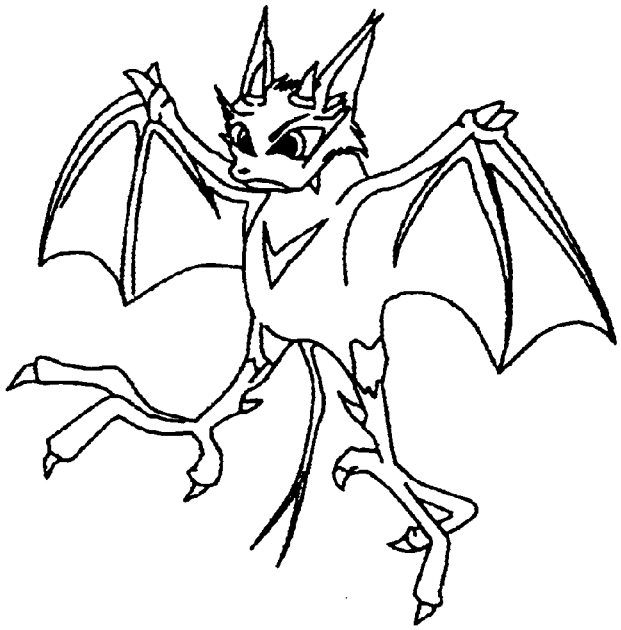
Fig. 37(B) Bearer (medium) Level 2
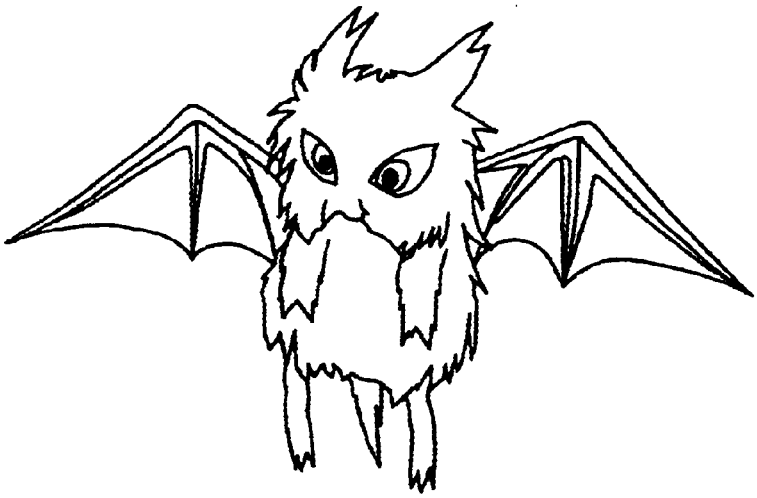
Fig. 37(C) Bearer (small) Level 3
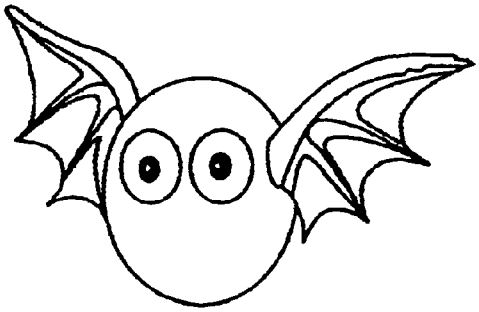

Scene after start lever actuated

Scene after start lever actuated
or upon 1st halt

GAME DEVICE AND MEDIUM MEMORIZING A GAME PROGRAM AND READABLE BY A COMPUTER FOR SUPPORT PLAYERS' TECHNICAL INTERVENTION WITHOUT CHANGING FUNDEMENTAL SPECIFICATION OF THE GAME DEVICE

DETAILED DESCRIPTION OF THE INVENTION

1. Field of the Invention

The present invention relates to a game device comprising as a core component a game machine which has such skill-intervention that users or players' levels of skill or senses for the game may be strongly reflected on the results of the game, or a game machine which provides room or elements players can attack, and a medium memorizing a game program and readable by a computer which game program allows the computer to perform a simulation game of the game machine having the skill-intervention and room or elements attacked by players.

2. Prior Art

In recent years, game machines such as Pachislot and Pachinko have been combined with control by a microcomputer so as to have various and deep playability. Books such as know-how magazines for attacks in the game introduce specifications and factors of popular game machines which players can attack and which have been simulated by a household computer software to enable players to enjoy the games simulation at home. In playing the game with Pachinko or Pachislot which are controlled by a microcomputer housed therein, players may win or lose the game fortunately or unfortunately on the one hand while there are definitely elements or factors of the game machines within their control properties and habitual behaviours to be attacked by players on the other hand, so that players' levels of skill and senses for the game are apparently reflected on the games results, resulting in a large difference in wins between skillful game-players and beginners.

In Pachislot, to receive payoff (or pay-out) of tokens or the value-mediums (used for the game and called "coins", medals, etc.), there are required such facts that random numbers taken at the instant of actuation of the start lever is "internally determined" to fall under an extent of a winning style, and that the stop button is to be pushed in a predetermined timing to allow specific designs or pictures (corresponding to the internally determined winning style) to be aligned, in a drawing section (or assist) containing four designs or pictures, with the winning lines. Hence, players essentially need to improve an operating technique of the stop buttons while understanding specific arrangement of the pictures on the wheels, and precisely grasp the content of the internal determination in order to obtain more tokens in the game.

In more detail, Bonuses such as Big Bonus or Regular Bonus may be internally determined, as foregoing, in a game upon actuation of the operating lever to make such first game as a (Bonus-)flagged game. Even when the required combination of pictures corresponding to the Bonus is not achieved in this flagged game, the Bonus-flagging can be carried over to a next game and those following the same and chances are given over and over again until the Bonus winning combination is achieved. However, pictures required for achieving Bonus provided on each wheel are few substantially, and it is not everyone such people who can readily precisely grasp the achievement of Bonus-flagging from a special pattern formed by stopped pictures on the wheels and suggesting a coming win or from an informing feature for Bonus-flagging by means of lamps behind the wheels, etc. Thus, beginners need to spend many games in vain after an initial game (wherein the Bonus flag is achieved) and until they finally achieve a combination of pictures corresponding to the Bonus.

In the general or ordinary games most regularly frequently performed prior to the internally determined Bonus, available winning styles are "Bit of Wins" or Replay whose internal determination cannot be carried over to next or following games as not like the Bonus-flagging. Thus, any winning styles other than those fully ensured of drawing would fail to be won. In this case, there are an attacking technique called DDT method aiming at a specific picture in view of a special pattern formed by the pictures on the wheels to avoid failure in winning, and an effective technique on the basis of DDT added with the probability of Bit of Wins winning and time efficiency required for the aiming technique. Beginners are poor in knowledge of such attacking techniques or in ability of "precisely aiming" to read precisely specific pictures on the rotating wheels and push the stop buttons in a proper timing, more or less resulting in failure in winning the Bit of Wins.

In the games related to Big Bonus, it is useful to play the provided Bonus games (other than early performing allowed maximal two or three games of Regular Bonus, initiated by a combination of three "Replay" pictures) while adopting an attacking technique called "Avoid Replay" wherein during usual or ordinary games (in a limit of times, e.g., 30 times) in the Big Bonus games, a combination of three "Replay" pictures is intentionally avoided to refrain from entering Regular Bonus in order to properly win Bit of Wins having higher probability of winning compared with usual cases. It is quite hard for beginners poor in the precisely aiming ability to play games in the above manner, thereby they can obtain merely reduced number of tokens in comparison with advanced or skillful players.

Moreover, in case of a game machine mounting a challenge time function (CT) wherein control to stop wheels on the basis of drawing random numbers is stopped after ending the Big Bonus games, there is an attacking technique called CT Max method wherein during CT function the aiming is used to freely win Bit of Wins, so that the number of tokens can be kept near a prescribed number of net increment while keeping a longer term for having chances of internal determination of Bonuses. Beginners poor in the precisely aiming ability cannot make use of the drawing-assist of four pictures (or designs) during the CT function, and rather loses tokens, and players having a medium skill not so good at the precise aiming operation compared with the advanced players causes the number of kept tokens to exceed the prescribed net increment before ending a prescribed number of games during CT operation, thereby early losing chances of entering again the Bonus games under a favourable condition affluent in tokens.

To play the games advantageously by use of the foregoing attacking techniques, it is required to improve the precisely aiming ability with understanding the arrangement of pictures or designs on the wheels, grasp precisely the internal determination results in specific situations of each game, and learn optimal operating procedures at the specific times on the above conditions. It is hard for ordinary people to obtain knowledges and operating skill of the game machine to the extent as above. Beginners are not fully satisfied with the game machine. Variation of people playing the game becomes limited, and some generation actually keep the game at a distance despite of various gaming properties.

Applying support functions for complementing players skill to the game machine is reviewed here. The support functions may be informing an operation timing (to cause an aimed picture or design to stop on the winning lines) by use of an indication means such as lamps, liquid crystal display, etc., a sound generating means such as a speaker, amplifier, etc., and a vibration generating means such as a vibrator, etc.; indicating arrangement of designs on the wheels to clarify specific pictures' positions on the wheels; indicating simulated wheels synchronized with the main wheels on a liquid crystal display screen, etc., and also indicating a marking on an aimed picture of such simulated wheels or emphasizing such picture to cause players to easily recognize the aimed picture(s) (or design(s)); teaching a most advantageous attacking technique correspondingly to occasional situation of games; indicating achieved flag(s) to suggest what winning style is to be aimed in the game; and indicating graphs showing failure in winning the wins to enable players to estimate the games.

In case that the above-mentioned support functions are merely added to the game machine, the support functions work uniformly to all of players not differentiated into beginners and advanced skillful players. It may happen that some support functions which are not required for some players would work to the same irrespective of their intent, or some support functions required for some players do not work when required.

In detail, careful support functions for beginners make simple and easier the game uniformly to all players, so that they are not required by advanced players (who very much practiced the techniques), do not give them interest and cannot truly make equalization. On the other hand, if support functions for the advanced players are applied uniformly, beginners do not at all understand it and the game is made complex vainly, so that the support functions do not serve as a support.

The "Pachislot" parlors (or halls) have hopes to serve respective customers (the players) in separate manners corresponding to specific reasons. In detail, they may think, for example, that regular customers or female players may be (or should be) given benefits; any players who long not improved in operation technique after much playing the game, or such beginners as having not yet understood the operation steps are to be provided with basic supports; and advanced players given fascinated supports facilitating further improvement of their skills. There were hitherto no game machines which have a function of changing specific support contents correspondingly to differences among players in skill, situation, circumstances, etc.

BRIEF DESCRIPTION OF THE INVENTION

An object of the present invention is to provide a game device, and a medium storing a game program and readable by a computer, the game device comprising as a core component a game machine having an excellent navigation function properly applying supports corresponding to players' technical levels or individual players, without perverted equality between beginners and advanced players and only the nominal support functions caused by uniformly actuating support functions, thanks to the fact that support functions are actuated on the basis of players technical levels or records in individual games histories of specific players, not like by merely uniformly applying support functions to the game machine to actuate the support functions irrespective of differences between beginners and advanced players.

The invention disclosed in claim 1 does, in order to apply a suitable support corresponding to specific technical levels of players, provide a game device having a support means favouring players wherein the support means supports players' technical intervention without changing fundamental specification of the game device, and there are provided a technical level qualifying means qualifying players' technical levels, and a support allowing means which allows actuation of the support means on the basis of the qualified technical levels. The definition "without changing fundamental specification of the game device" does neither mean nor include adjustment of the wheel rotation numbers and adjustment of the number of wheel-slide designs.

The invention in claim 2 does, in order to apply supports stepwise and minutely correspondingly to specific high or low technical levels, provide the support means with a plural steps of support elements separated correspondingly to difference in technical levels, and also with a supports-choosing means for choosing, on the basis of qualified high or low technical level, a support element to be allowed of actuation.

The invention disclosed in claim 3 does, in order to properly carry out supporting beginners for enabling winning Bonus, comprise plural lines of a changeable indication means which changeably indicates a plurality of designs or pictures including those corresponding to Bonus, and a stop means for stopping a predetermined design or picture of each line on a winning line correspondingly to an operation timing, and the invention qualifies a technical level into a lower rank whenever the number of games that the Bonus designs are not aligned on the winning lines to win no Bonus becomes larger after a first game in which Bonus is internally determined and Bonus-flag is achieved, and the invention chooses a support element enabling the Bonus designs to be readily aligned on the winning lines whenever the technical level is qualified in a lower rank. The Bonus referred to here includes both of Big Bonus and Regular Bonus.

The invention disclosed in claim 4 does, in order to properly support beginners for enabling benefit obtained in Big Bonus to be kept at a degree over a predetermined value, comprise plural lines of changeable indication means, which changeably indicates a plurality of designs or pictures including those for Bonus for providing a winning style of Big Bonus that is a combination of effective ordinary game(s) in limited times and Regular Bonus(es) in limited times and ends depending on any limitations; and a stop means for stopping a predetermined design or picture of each line on a winning line corresponding to operation timing; wherein a technical level is qualified into a lower rank whenever benefit given in the middle of Big Bonus is smaller, and there is chosen a support element facilitating increase of benefit to be obtained whenever the technical level is qualified in a lower rank.

The invention disclosed in claim 5 does, in order to properly support unfortunate players in ordinary games most frequently performed prior to internal winning determination of Bonus, comprise plural lines of changeable indication means which changeably indicates a plural designs or pictures including those for Bonus and for Bit of Wins; a stop means for stopping a predetermined design or a picture of each line on a winning line corresponding to operation timing, wherein a technical level is qualified into a lower rank whenever the number of games is larger in the time from the end of previous Bonus to that Bonus is achieved again, and there is chosen a support element enabling the winning designs to be readily aligned on the winning lines whenever the technical level is qualified in the lower rank.

The invention disclosed in claim 6 does, in order to properly support beginners in ordinary games most frequently performed prior to internal winning determination of Bonus, comprise plural lines of changeable indication means which changeably indicates a plural designs or pictures including those for Bonus and for Bit of Wins; a stop means for stopping a predetermined design or a picture of each line on a winning line corresponding to operation timing, wherein a technical level is qualified into a lower rank whenever failure in winning is much, and there is chosen a support element enabling the winning designs to be readily aligned on the winning lines whenever the technical level is qualified in the lower rank.

The invention disclosed in claim 7 does, in order to precisely grasp players technical levels in a long term to apply a suitable support based on the same, provide that the technical level qualifying means qualifies technical levels correspondingly to specific values of points recognized from records in an individual games history recording means for specific players. The individual games history recording means includes membership cards in the form of IC cards, magnetic cards, etc.

The invention disclosed in claim 8 does, in order to apply properly a support to players, correspondingly to their technical levels, in a simulated game with a medium (such as a compact disc or ROM cartridge) readable by a computer, provide a medium storing a game program and readable by a computer, the medium comprising a support procedure description describing a dealing procedure for support functions favouring players, the support functions supporting players' technical intervention without changing fundamental specification of the game device, the game program causing the computer to fulfill a game support method having a technical level qualifying step qualifying technical levels of players and an allowing step allowing actuation of the support functions on the basis of the qualified technical levels.

The invention disclosed in claim 9 does, in order to apply a suitable support corresponding to specific players, provide that in a game device comprising a support means favouring players, wherein the support means supports players' technical intervention without changing fundamental specification of the game device, and there is provided a support allowing means for allowing actuation of the support means on the basis of records in an individual games history recording means for specific players. The individual games history recording means include membership cards in the form of IC cards, magnetic cards, etc.

The invention disclosed in claim 10 does, in order to hold fairness and objectiveness in applying support to players by means of a system using points, provide that the support allowing means allows actuation of the support means on the basis of comparison between reference values and specific values of points recognized from the records in the individual games history recording means.

The invention disclosed in claim 11 does, in order to apply various supports, provide that the support means includes plural kinds of support elements showing separate support functions in different features, and points values and reference values are classified for respective support elements.

The invention disclosed in claim 12 does, in order to apply minute supports, provide that the support means includes plural steps of subdivided support elements providing relative importance in contents of support, and reference values for specific points values are set for respective subdivided support elements.

The invention disclosed in claim 13 does, in order to apply suitable supports corresponding to the game's aspects, provide that the reference values for specific points values are set in different values correspondingly to difference in aspects of the game.

The invention disclosed in claim 14 does, in order to flexibly cope with the Pachislot parlors' business method serving players well in various manners, provide that the reference values for specific points values are changeable in setting from the outside.

The invention disclosed in claim 15 does, in order to provide beginners with a suitable navigation, provide that the support means is provided for beginners to be useful for mitigating difficulty in the game.

The invention disclosed in claim 16 does, in order to facilitate further improvement of skill of advanced players, provide that the support means is provided for advanced players to be useful for estimation of the game.

The invention disclosed in claim 17 does, in order to apply fairly supports to both of beginners and advanced players, provide the support means includes those for beginners useful for mitigating difficulty in the game and those for advanced players useful for estimation of the game.

The invention disclosed in claim 18 does, in order to leave out advanced players from supports for beginners as much as it could be since advanced players when showing an excellent games results do not need to be applied positively with supports for beginners, provide that there are provided plural lines of changeable indication means which makes changeable indication on condition of insertion or use of value-mediums; a stop means for stopping a predetermined design on each line of the changeable indication means on a winning line correspondingly to operation timing; and a pay-out or payoff means for paying out a predetermined number of value-mediums upon achievement of winning; and an updating means which updates the records in the individual games history recording means in a manner of causing specific points values corresponding to the support means for beginners to be away from reference values when a gain-ratio that is a ratio between value-mediums used and those paid out is over a predetermined value.

The invention disclosed in claim 19 does, in order to fascinate advanced players showing excellent games results to facilitate them to further improve their skill, provide that there are provided plural lines of changeable indication means which makes changeable indication on condition of insertion or use of value-mediums; a stop means for stopping a predetermined design on each line of the changeable indication means on a winning line correspondingly to operation timing; and a pay-out or payoff means for paying out a predetermined number of value-mediums upon achievement of winning; and an updating means which updates the records in the individual games history recording means in a manner of causing specific points values corresponding to the support means for advanced players to be near reference values when a gain-ratio that is a ratio between value-mediums used and those paid out is over a predetermined value.

The invention disclosed in claim 20 does, in order to leave out advanced players from supports for beginners as much as it could be since advanced players when showing an excellent games results in Big Bonus do not need to be applied positively with supports for beginners, provide that there are provided plural lines of changeable indication means, which changeably indicates a plurality of designs or pictures including those for Bonus for providing a winning style of Big Bonus that is a combination of effective ordinary game(s) in limited times and Regular Bonus(es) in limited times and ends depending on any limitations; and a stop means for stopping a predetermined design or picture of each line of the changeable indication means on a winning line correspondingly to operation timing; and an updating means which updates the records in the individual games history recording means in a manner of causing specific points values corresponding to the support means for beginners to be away from reference values when an average obtained benefit in Big Bonus is over a predetermined value.

The invention disclosed in claim 21 does, in order to fascinate advanced players showing excellent games results to facilitate them to further improve their skill, provide that there are provided plural lines of changeable indication means, which changeably indicates a plurality of designs or pictures including those for Bonus for providing a winning style of Big Bonus that is a combination of effective ordinary game(s) in limited times and Regular Bonus(es) in limited times and ends depending on any limitations; and a stop means for stopping a predetermined design or picture of each line of the changeable indication means on a winning line correspondingly to operation timing; and an updating means which updates the records in the individual games history recording means in a manner of causing specific points values corresponding to the support means for advanced players to be near reference values when an average obtained benefit in Big Bonus is over a predetermined value.

The invention disclosed in claim 22 or 23 does, in order to measure degrees of use of the game in view of the number of achievement of Big Bonus so as to apply a suitable support to players, i.e., the game enthusiasts showing a high degree of use of the game, provide an updating means which updates the records in the individual games history recording means in a manner of causing specific points values for allowing actuation of the support means to be near reference values when the number of achievement of Big Bonus is over a predetermined value.

The invention disclosed in claim 24 does, in order to apply a suitable support to players, i.e., the game enthusiasts showing a high degree of use of the game, provide an updating means which updates the records in the individual games history recording means in a manner of causing specific points values for allowing actuation of the support means to be near reference values when an extent of use of the game is over a predetermined value.

The invention disclosed in claim 25 does, in order to apply supports correspondingly to difference in ages, sexes, etc., so as to correct leaning of classes of players, provide that recorded in the individual games history recording means is personal information which weights specific points values for allowing actuation of the support means.

The invention disclosed in claim 26 does, in order to apply fairly and properly supports in a simulation game through a medium readable by a computer, such as a compact disc or a ROM cartridge, provide a medium storing or memorizing a game program and readable by a computer, the medium comprising a support procedure description describing a disposing procedure for support functions favouring players, the support functions supporting players' technical intervention without changing fundamental specification of the game device, the game program causing the computer to fulfill a game support method having a reading step reading records in the individual games history for specific players, an allowing step allowing actuation of the support functions on the basis of the read individual games history, and an updating step updating the records in the individual games history upon end of the game.

Next, functional effects of the inventions will be detailed.

In the invention set forth in claim 1, actuation of the support means is allowed by the support allowing means on the basis of the players technical levels qualified by the technical levels qualifying means. That is, actuation of the support means is allowed or not depending upon specific technical levels of players. Hence, there causes no perverted equality between beginners and advanced players and prevents the support functions from being only the nominal as the case uniformly applying the support functions. The support functions can be provided properly correspondingly to players specific technical levels.

In the invention disclosed in claim 2, correspondingly to qualified higher or lower technical levels, a plurality of steps of support elements divided for specific technical levels are subjected to choosing. Hence, beginners low in technical level could be given a careful or kind support, i.e., applied with an effective and minute support.

In the invention disclosed in claim 3, a support element enabling the Bonus designs to be readily aligned on the winning line is chosen in case that the number of games, after a first game in which Bonus is internally determined to have Bonus-flag, is larger with Bonus designs being not aligned on the winning line resulting in no winning Bonus. Hence, beginners who not winning Bonus easily to spend games vainly can be applied with careful support to be effectively saved. The support elements are provided for saving beginners about their disadvantages over a predetermined limit under Bonus internally determined. Advanced players who can early win Bonus do not need to be given such support. There causes no unequalness to Advanced players when not applied with the support.

In the invention disclosed in claim 4, when obtained benefit in the middle of Big Bonus is smaller, a support element enabling to facilitate increase of the obtained benefit is chosen. Hence, beginners who cannot fully enjoy benefit to be obtained substantially in Big Bonus could be given a careful support and effectively saved about their disadvantage in a predetermined limit. Advanced players who can fully enjoy benefit in Big Bonus need little to be given such support, so that there causes no unequalness when they are not applied with the support.

In the invention disclosed in claim 5, a support element enabling winning designs to be readily aligned on the winning line is chosen when the number of games is larger until Bonus is achieved again after the end of a preceding Bonus. A main cause that Bonus is long not achieved may be the fact that Bonus is not internally determined by the random numbers lot, which fact is inevitability not relating to players technique. The players are just in bad luck. It is heard that fortune is directed by players ability, and one of games technique is to coolly decide a time to stop playing the game or to change the game devices for playing with a further one thereof. Advanced players who long undergo bad luck should be also treated similarly with beginners. In such case of long bad luck, an effective support is to enable players to be reduced of failure in winning Bit of wins. A support element enabling winning designs to be readily aligned on the winning line is chosen when the bad luck is high, so that beginners who apt to fail to win Bit of Wins can be saved of disadvantage in a predetermined limit, and also advanced players who can make use of DDT method or the like can be mitigated in precise aiming to thereby reduced in fatigue.

In the invention disclosed in claim 6, when failure in winning is much, a support element enabling winning designs to be readily aligned on a winning line. Hence, beginners who apt to fail to win winning styles internally determined can be saved of disadvantage in a predetermined limit. Advanced players who has little failure in winning are not applied with supports, which does not form unequalness to advanced players who have little disadvantage due to failure in winning.

In the invention disclosed in claim 7, players technical levels are qualified on the basis of points values recognized from the records in the individual games history recording means for specific players. Actuation of the support means is allowed on the basis of the qualified technical levels. Hence, technical levels are grasped from the individual games history recording means for specific players, i.e., a games history stored in a long term, and the support is applied on the basis of the grasped technical levels. Players can be supported suitably correspondingly to their technical levels.

In the invention disclosed in claim 8, the technical level qualifying step qualifies the players' technical level, and the allowing step allows, on the basis of the qualified technical level, actuation of the support functions described in the support procedure description. In detail, actuation of the support functions is allowed or not correspondingly to players' technical levels. There does not cause perverted equality between beginners and advanced players and only the nominal support, not like the case uniformly applying support functions. Supports can be suitably applied correspondingly to players' specific technical levels in a simulation game through a medium such as a compact disc, a ROM cartridge, etc., readable by a computer.

In the invention disclosed in claim 9, actuation of the support means is allowed on the basis of the records in the individual games history recording means for specific players. Hence, actuation of the support means is allowed or not correspondingly to the individual games history for specific players. There does not cause perverted equality between beginners and advanced players and only the nominal support, not like the case uniformly applying the support functions. Supports can be applied suitably under proper circumstances.

In the invention disclosed in claim 10, actuation of the support means is allowed on the basis of comparison between reference values and points values recognized in the records in the individual games history recording means. By means of the system using the points values, players are made interested in points values and the game is made fascinating, and conditions for applying the supports are objective and fair.

In the invention disclosed in claim 11, on the basis of comparison between reference values and points values classified for specific support elements, actuation of the support elements corresponding to the reference values are allowed. The support elements show various features of support functions and apply various supports to players.

In the invention disclosed in claim 12, on the basis of comparison between points values and reference values for points values set for specific subdivided support elements, actuation of the subdivided support elements corresponding to the reference values are allowed. The subdivided support elements are weighted of the contents of supports to thereby apply supports stepwise and minutely.

In the invention disclosed in claim 13, reference values for points values are different correspondingly to difference in aspects of the game. The support may be applied in an aspect of the game but may be not applied in other aspects of the game. Hence, the supports vary correspondingly to the game aspects and can be applied properly.

In the invention disclosed in claim 14, adjustment by changing from the outside the setting of reference values of points values can be made to cause the supports to be readily applied or difficult to be applied. Hence, the Pachislot parlors are enabled to serve the customers in daily different manners or the like.

In the invention disclosed in claim 15, actuation of support means for beginners useful for mitigating difficulties in the game is allowed, so that difficulties for beginners in the game can be eased to provide them with a suitable navigation.

In the invention disclosed in claim 16, actuation of support means for advanced players useful for estimating the game is allowed. Advanced players are enabled to review their games and make use of reflection taken from the review for a next game, thereby facilitating them to further improve their skills.

In the invention disclosed in claim 17, the support means includes both of those for beginners and those for advanced players and can fascinate all the players.

In the invention disclosed in claim 18, for advanced players who show a gain-ratio over a predetermined value, points values corresponding to support means for beginners are updated as to be away from the reference values. Hence, supports can be easily applied to beginners needing supports while supports are hard to be given to advanced players who need little the supports. Thus, a suitable support can be applied with giving importance to saving beginners.

In the invention disclosed in claim 19, for advanced players who show a gain-ratio over a predetermined value, points values corresponding to support means for advanced players are updated as to be near the reference values. Hence, supports are easily applied to advanced players to facilitate them to further improve their skills, resulting in fascinating advanced players.

In the invention disclosed in claim 20, for advanced players who has an average obtained benefit in Big Bonus over a predetermined value, points values corresponding to support means for beginners are updated as to be away from the reference values. Hence, supports can be easily applied to beginners needing supports while supports are hard to be given to advanced players who need little the supports. Thus, a suitable support can be applied with giving importance to saving beginners.

In the invention disclosed in claim 21, for advanced players who has an average obtained benefit in Big Bonus over a predetermined value, points values corresponding to support means for advanced players are updated as to be near the reference values. Hence, supports are easily applied to advanced players to facilitate them to further improve their skills, resulting in fascinating advanced players.

In the invention disclosed in claim 20 or 23, when the number of achievement of Big Bonus is over a predetermined value, such player may be judged as a customer showing high degree of use of the game. In this case, points values to apply supports are updated as to be near the reference values, whereby supports may be easily applied in a next game, providing suitably supports to the customer showing high degree of use of the game.

In the invention disclosed in claim 24, for a customer showing high degree of use of the game over a predetermined value, points values to apply supports are updated to be near reference values, whereby supports may be easily applied in a next game, providing suitably supports to the customer showing high degree of use of the game.

In the invention disclosed in claim 25, on the basis of personal information recorded in the individual games history recording means, points values may be weighted, so that aged persons, women, etc., may be brought into a situation easily applied with supports. Hence, classes seldom playing the game or of few players can be also attracted, thereby correcting leaning or clustering of classes of players.

In the invention disclosed in claim 26, the reading step reads the records in the individual games history for specific players, and on the basis of the same the actuation of support functions described in the support procedure description is allowed by the allowing step. In detail, actuation of the support means is allowed or not allowed correspondingly to the individual games history for specific players. Hence, there does not cause perverted equality between beginners and advanced players and only the nominal support, not like the case uniformly applying support functions. Supports can be applied fairly and properly in a simulation game through a medium such as a compact disc, ROM cartridge, etc., readable by a computer. And upon end of the game, the updating step updates the games history to cause it to reflect the game just having ended, thereby enabling players to have updated information with respect to a next game.

BRIEF DESCRIPTION OF THE DRAWINGS

FIG. 4 is a list of winning styles or wins in the game machine.

FIG. 10 is an explanatory view for one of support means, i.e., showing operational technique.

FIG. 12 is a list of support means.

FIG. 17 is a table showing correlation between records in membership cards and specific points values.

FIG. 18 is a table showing correlation between points values and reference or standard values.

FIG. 34 is a table of points-addition for specific levels.

FIG. 35 is a table for level-setting.

FIG. 37 is an explanatory view for a bearer.

PREFERRED EMBODIMENTS OF THE INVENTION

Figure 1:
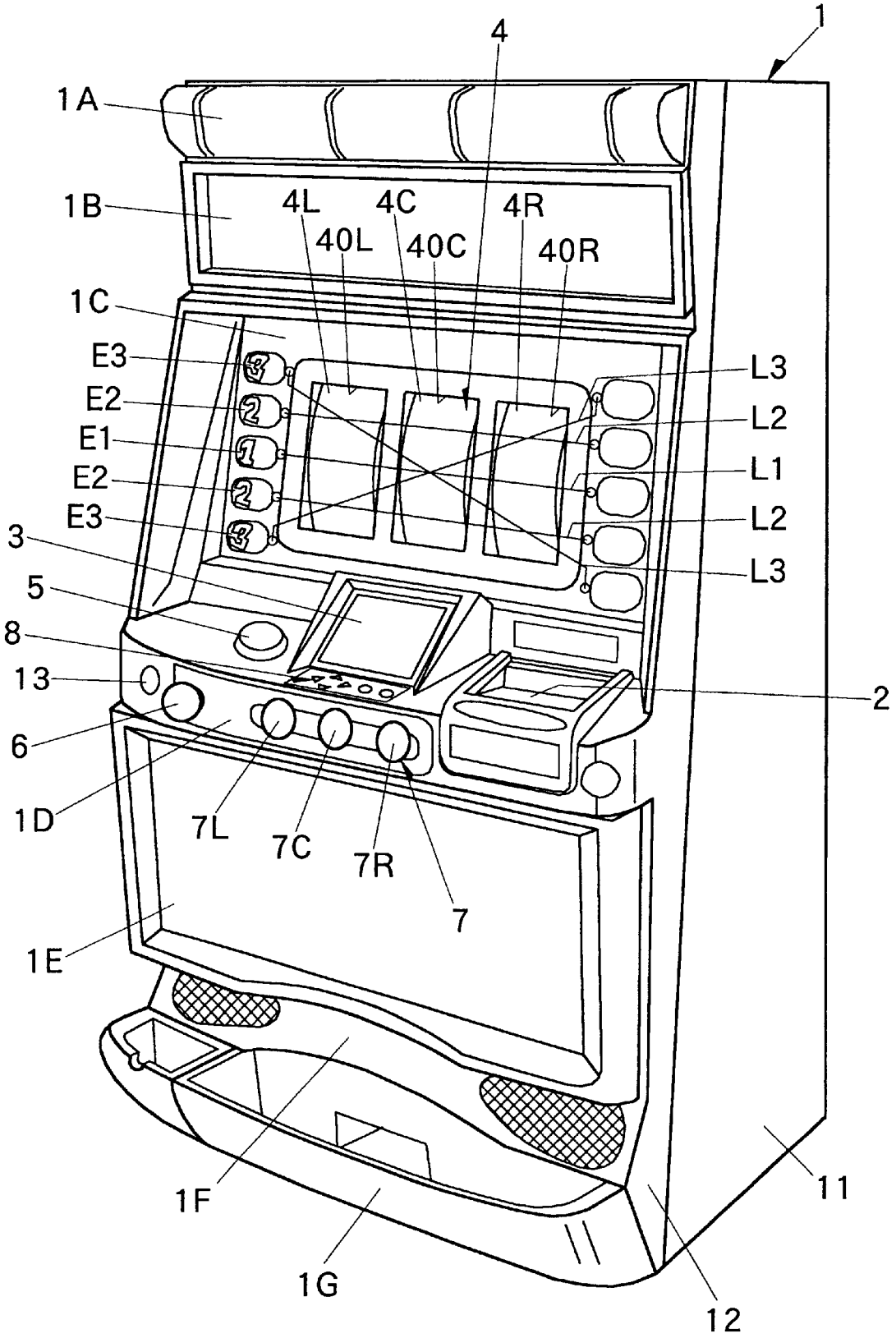
FIG. 1 is a perspective view showing a game machine forming a core component of a game device applied with the present invention.

FIG. 1 shows a slot machine of "Pachinko" type, i.e., a Pachislot machine applied with the present invention. Used as tokens (or a "value-medium" for playing the game, and usually called "coins") are games medals about 25 mm in diameter. The machine body 1 comprises a box-shaped casing 11 and a front door 12 openable forwards and has at the top a game-situation indicator 1A, and downwardly, a payoff table panel 1B, a wheels panel 1C, a switches board 1D, a lower panel 1E, a front-speaker panel 1F, and a payoff return 1G. The switches board 1D is provided with a coin-lump insertion slot 2 receiving plural coins at a time and an image display device 3 comprising a liquid crystal display. The coin-lump insertion slot 2 may be replaced with a conventional coin-slot receiving coins one by one.

Figure 2:
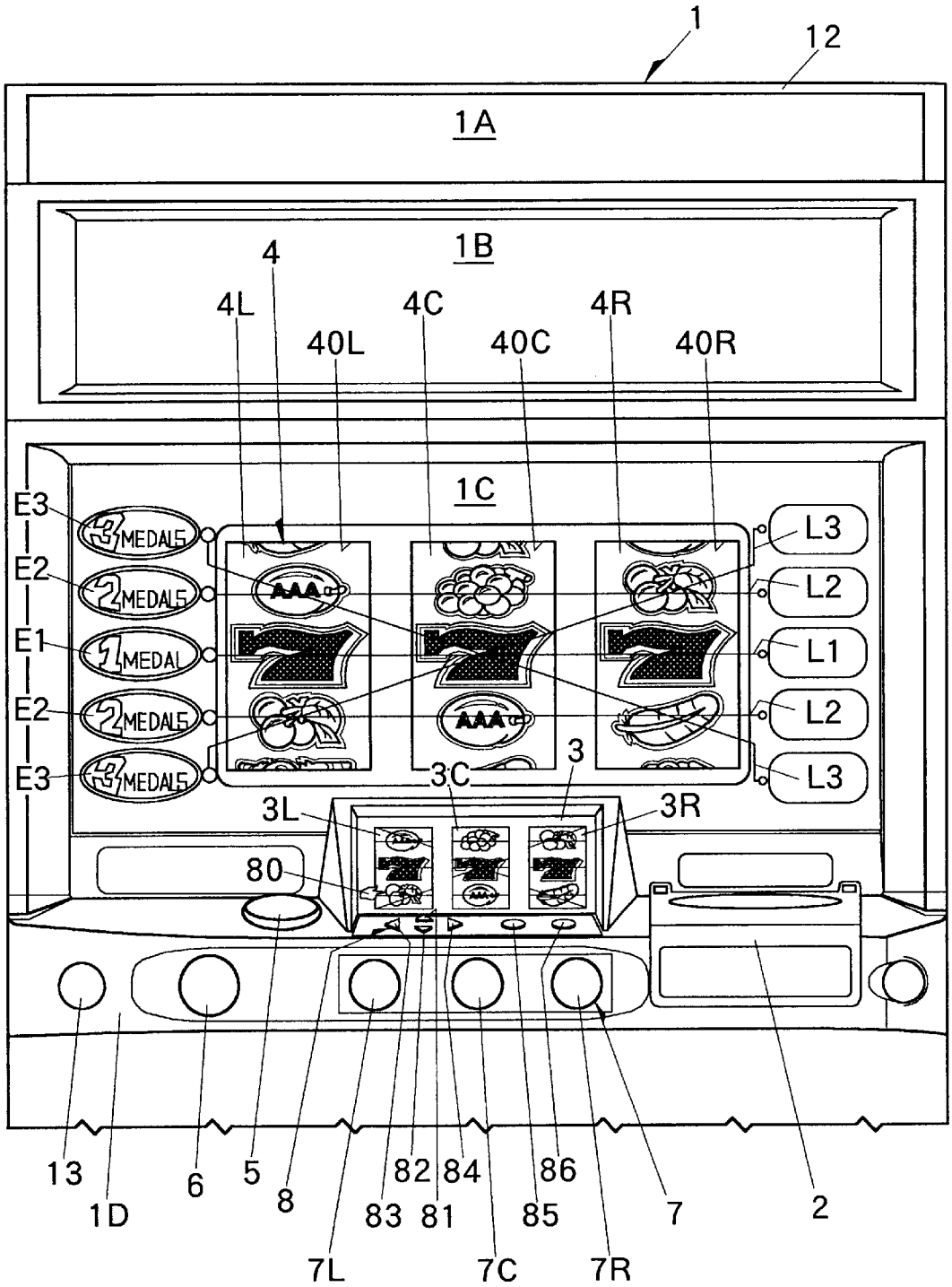
FIG. 2 is a front view of an upper part of the game machine.

As seen in FIG. 2, a changeably indicating means 4 comprising left-hand, middle and right-hand wheels 4L, 4C and 4R each putting on their outer peripheries specific designs (or pictures) as "Red Seven", "Cherry", etc., is housed inside the wheels panel 1C. Upon stoppage of the wheels, three (upper, middle and lower) designs on each wheel can be clearly seen through indication windows 40L, 40C, and 40R.

The number of coins (tokens) to be bet for each specific single game is decided by use of a bet switch 5 which may be depressed once to bet three coins (which number is most frequent), twice for two and three times or more for one coin. Alternatively, the number of coins to be bet may be proportional to the times of depression of switch 5, or separate bet switches may be provided for each number (1, 2 or 3) of betting. Depending upon the number of coins to be bet, for example, one coin makes valid the single central winning line L1, two coins does so three lines including upper and lower ones L2, L2, and three coins five lines further including slanted lines L3, L3. Laterally provided indicator lamps E1 to E3 light correspondingly to valid winning lines. In Jack Game operation during the Regular and Big Bonuses, one coin betting is always selected irrespective of any depression times of the bet switch 5.

Start of each (single) game is actuated by tapping a freely swingable start lever 6 in a state that coin(s) have been bet (i.e., the value-medium has been used). The three wheels 4L, 4C, 4R rotate simultaneously. Stop means 7 comprising left-hand, central and right-hand stop buttons 7L, 7C, 7R are operated to stop separately the wheels 4L, 4C, 4R, so that specific combinations of the designs (put on the wheels) on the valid winning lines can decide winning or none on the basis of variation of which winning the number of coins to be paid are decided.

The image display device 3 shows on the screen three simulation wheels 3L, 3C, 3R which have the same designs as of the wheels 4L, 4C, 4R and rotate and stop simultaneously (synchronized) therewith. An operation switch 8 for setting (and for other operations) the aiming marker described later is formed in front of the image display device 3 and comprises an upper button 81, a lower button 82, a left-hand button 83, and a right-hand button 84 for moving upwards, downwards, leftwards and rightwards a cursor 80 over the image display device 3, and further a decision button 85 and a cancel button 86.

In FIG. 2, reference numeral 13 designates a settlement switch which makes switching between a credit state wherein coins are previously memorized (with an upper limit of 50 coins) also for any following games and a settlement state wherein coins in credit are paid off to the return 1G.

Figure 3:
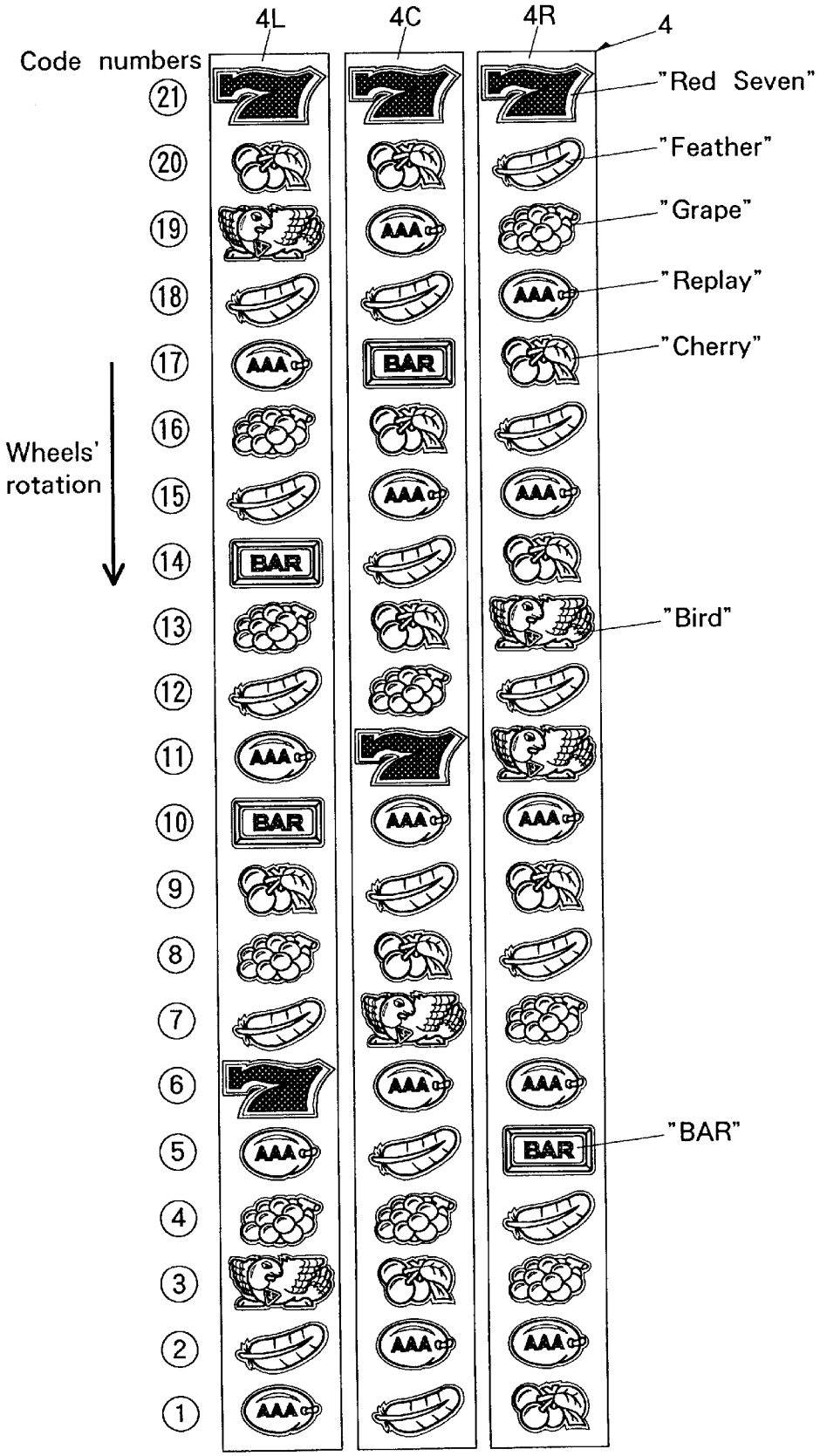
FIG. 3 is an expanded view of wheels of the game machine.

As shown in FIG. 3, the wheels 4L, 4C, 4R each have 21 designs put with code numbers 1 to 21. The designs in 7 kinds are "Red Seven", "Bird" and "BAR", those for Bonus operation, "Grape", "Feather" and "Cherry", those for Bit of Wins, and "Replay". The bands of the main wheels 4L, 4C, 4R are connected at the upper and lower ends with each other to make loop and rotate as indicated by the arrow.

As seen in FIG. 4, the winning styles or wins are Big Bonus, Regular Bonus, Bit of Wins, Replay and Jack Game winning. The design "Cherry" which makes winning even if aligned only on the left-hand wheel 4L enables 4 coins payoff when aligned on the upper or lower winning line upon 3 coins betting. This Pachislot machine is the so-called "A" type wherein in Big Bonus operation, particularly, during 30 times of ordinary games having a higher probability of winning the main Bit of Wins "Feather-Feather-Feather" in comparison with that in general games on other stages than Big Bonus, about 360 coins could be obtained through three sets of Regular Bonus which each may enable 8 times at maximum of 15 coins payoff in 12 Jack Games each starting with alignment of three "Replay" designs. The invention may be applicable to other types of machines such as B type with 2 sets of Regular Bonus in Big Bonus, B-CT type added (to B type) with a CT game, and C type including concentration of single Bonus winnings.

Figure 5:
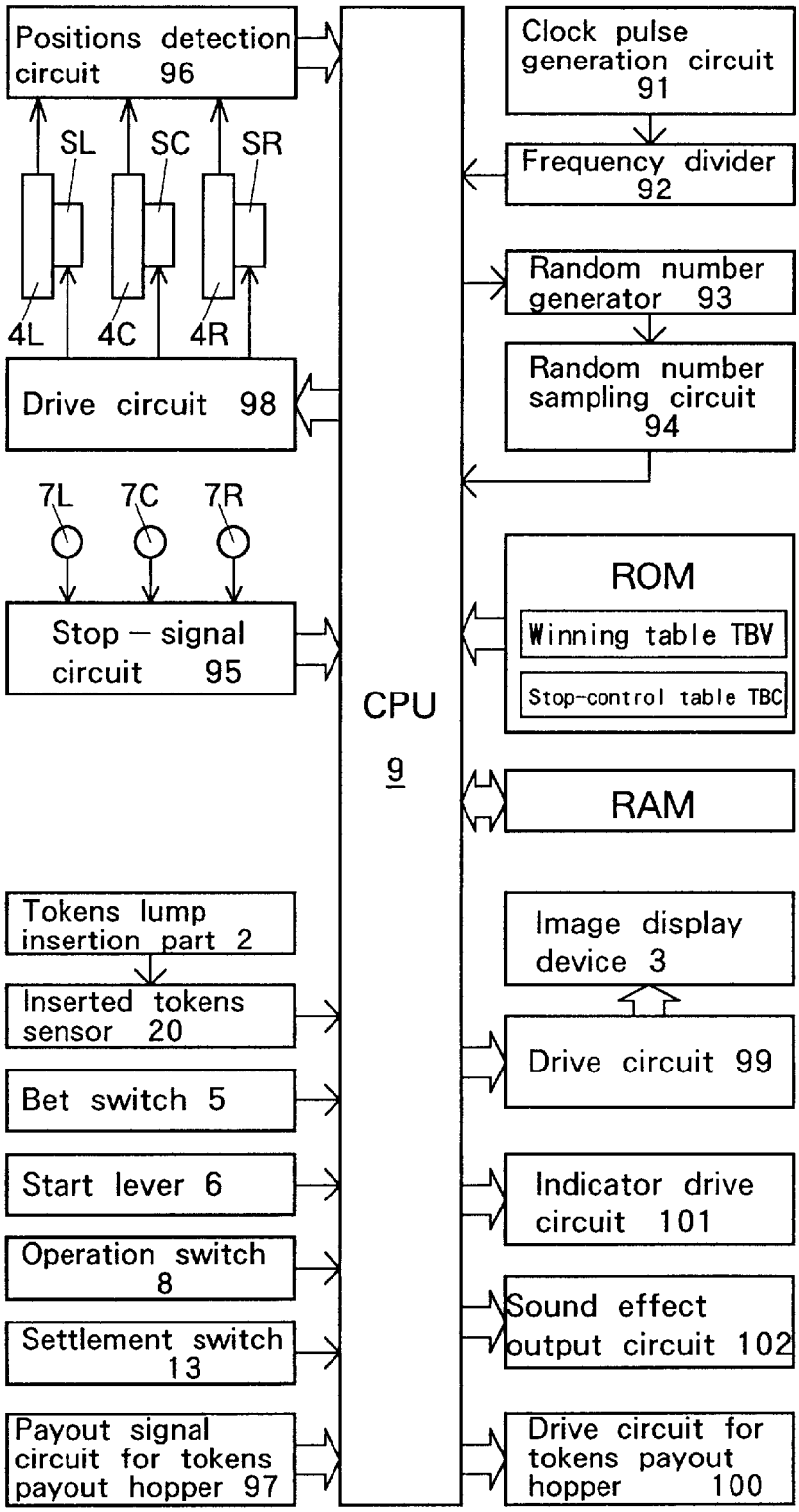
FIG. 5 is a block diagram of control of a first embodiment of the game device.

FIG. 5 is a block diagram of a controller controlling the whole of the game and having a main control unit 9 comprising a microcomputer CPU, read only memory ROM and random access memory RAM. 91 designates a clock pulse generation circuit, 92 a frequency divider, 93 a random number generator, and 94 a random number sampling circuit. On the basis of comparison and determination between random numbers taken at an instant when the start lever 6 tapped and winning table TBV memorized in ROM, presence or none of internal winning determination, and winning styles are decided. A Bonus-flag resulting from internal winning determination of Big Bonus or Regular Bonus can be carried over to following games, while results of internal winning determination regarding Bit of Wins and Replay are applicable only to the game concerned.

Connected to the input side of CPU are an inserted-coins sensor 20 detecting coins inserted through the coins-lump insertion slot 2, bet switch 5, start lever 6, operation switch 8 for the image display device 3, settlement switch 13, a stop-signal circuit 95 having, as input, stop buttons 7L, 7C, 7R, a position-detecting circuit 96 for wheels 4L, 4C, 4R, and a payoff signal circuit 97 for a housed coin-payoff hopper.

Connected to the output side of CPU are a drive circuit 98 for stepping motors SL, SC, SR directly connected to the wheels 4L, 4C, 4R, a drive circuit 99 for the image display device 3, a drive circuit 100 for the coin-payoff hopper, an indicator-drive circuit 101 for driving the game-state indicator 1A, lamps mounted behind the main wheels 4L, 4C, 4R, and so on, and a sound effect output circuit 102 connected to a speaker(or amplifier).

When the start lever 6 is tapped to cause the wheels 4L, 4C, 4R to start rotation and rotate at a predetermined constant speed, the stop buttons 7L, 7C, 7R are allowed to be operated depressed, so that on the basis of input to the stop signal circuit 95 and position-detecting circuit 96 and stop-control table TBC on the ROM, seven designs, i.e., specific three consecutive designs on each wheel (to be stopped in a shortest time-interval) plus four coming designs are checked out. Any design(s) if corresponds to a winning style or wins subjected to internal winning determination are caused to undergo a pull-into control enabling the designs to be aligned on a valid winning line(s), and a kick-away control preventing achievement of other winning styles not subjected to internal winning determination is carried out, stopping the wheels 4L, 4C, and 4R.

In case of a blank having no internal winning determination, the wheels 4L, 4C, 4R are stopped in a manner of achieving no winning styles. Even in a game in which Bonus-flag is carried over, i.e., with Bonus having been internally determined, other than Bonus is subjected to internal winning determination. When Bit of Wins or Replay is internally determined, the result is taken precedence and subject to the pull-into control and kick-away control, stopping the wheels 4L, 4C, 4R.

Probability of internal winning determination of Big. Bonus is low as 1/240 (setting No. 6) to 1/297 (setting No. 1), and that of Regular Bonus 1/364 to 1/468. Once subjected to internal winning determination, chances do not become void even if winning Bonus is not achieved in a flagged game. However, each wheel contains only few designs for Bonus, so that it is not easy for beginners poor in precisely aiming ability to cause the designs for Bonus to be combined even by use of assist with the four designs pull-into control.

The main control 9 monitors the cumulative total of games achieving no winning after Bonus-flagging as a latest game history; qualifies players technical levels correspondingly to the number of games, in which Bonus designs not aligned on the winning line and not to win Bonus, after a first game in which Bonus internally determined and Bonus-flag achieved; and allows, on the basis of the qualified technical levels, actuation of support means useful for causing Bonus designs to be aligned on the winning line.

Figure 6:
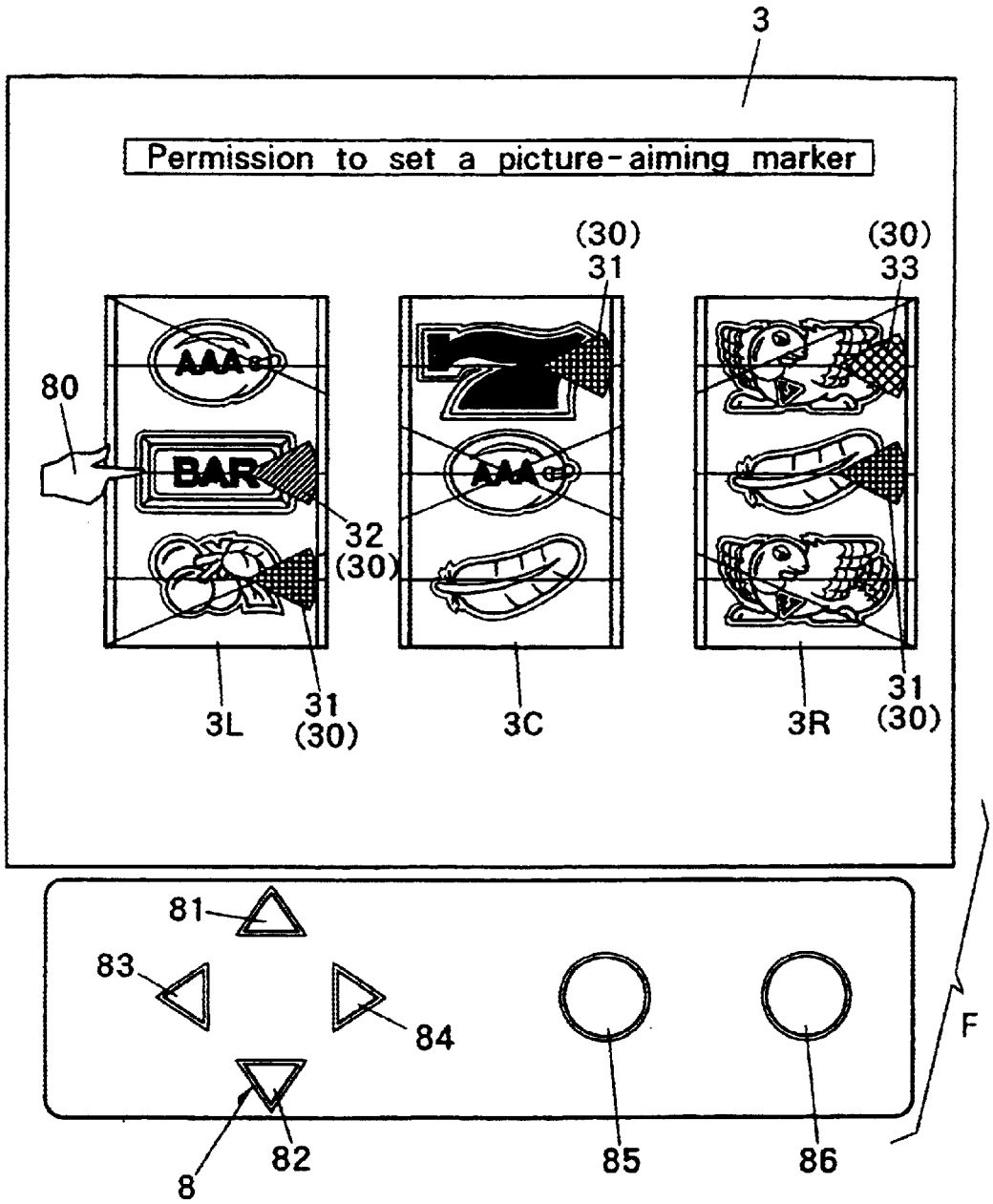
FIG. 6 is an explanatory view for one of support means, i.e., allowing setting of an aiming marker.

As seen in FIG. 6, a first embodiment of the support means with Bonus having been subjected to internal winning determination is to allow setting of an aiming marker 30 over or on any desirable designs put in simulated wheels 3L, 3C, 3R. In case of 15 games or more after Bonus-flagging, technical level is qualified as beginners level and middle-level, and setting the aiming markers on the image display device 3 is allowed until the number of games exceeds 25 games. The upper, lower, left-hand and right-hand buttons 81, 82, 83, 84 may be used to move the cursor 80 over the left-hand, central and right-hand lines and the upper, middle and lower winning lines. In case the cursor 80 is positioned on the upper or lower winning line and when the upper button 81 or lower button 82 is depressed, the simulated wheel of the concerned line scrolls downwards or upwards and a hidden design appears. The decision button 85 is depressed to put a marker 30 laterally righthand of the design correspondingly to the cursor 80. The marker 30 moves together with the design on which the marker is provided.

The markers 30 may be provided in a manner of one for each vertical line, or three or less (colored in red, blue or green) for each vertical line. A marker first provided on each vertical line may be a red marker 31, a second one a blue marker 32 and a third one a green marker 33 in the order. Cancel button 86 when depressed cancels all the markers 30. Since operating efficiency of the game lowers after spending 25 games, the markers are then not allowed to be set. Such limitation may be not provided. In any case, a marker 30 finally put remains until Bonus winning is achieved.

The start lever 6 is tapped to cause the simulation wheels 3L, 3C, 3R to have or indicate thereon the same designs as of the wheels 41, 4C, 4R and be synchronized therewith in rotation. Accordingly, thanks to the marker 30 put on the simulation wheels 3L, 3C, 3R, the aiming operation is complemented to save or assist beginners and middle-grade players. Advanced players who can early obtain Bonus winning without using the markers would not be given unequalness particularly by the marker adding function. Any of beginners or middle-grade players may dispense with the markers. It is in players discretion to use or not use the markers under the state the marker setting is allowed. The specific conditions such as the number of games at which setting the marker 30 is allowed may be changeable or variable.

Markers 30 may be uniformly automatically put on at least one of "Red Seven" among the Bonus designs on each vertical line, or also put (in different colors) on a second "Red Seven" or "BAR", other than the foregoing feature of players freely setting on desired designs. Alternatively, as markers 30, marker lamps may be fit to the main wheels 4L, 4C, 4R to light, or lamps mounted behind the wheels may be used to be lit when or at the instant that "Red Seven" and others pass the indication windows 40L, 40c, 40R.

In addition to the visual markers, there may be provided a sound like a metronome generated at an instant that at least one of Bonus designs, "Red Seven", passes the indication windows 40L, 40C, 40R, or a vibration at the stop buttons 7L, 7C, 7R, start lever 6, or a part of front door 12. In case that sound generation or vibration is applied once per rotation for one "Red Seven", rhythm interval is 0.75 sec at 80 r.p.m. of the wheels. And rhythm interval 1.5 sec. in case of once per two rotations, and 3 sec. in case of once per four rotations.

Figure 7:
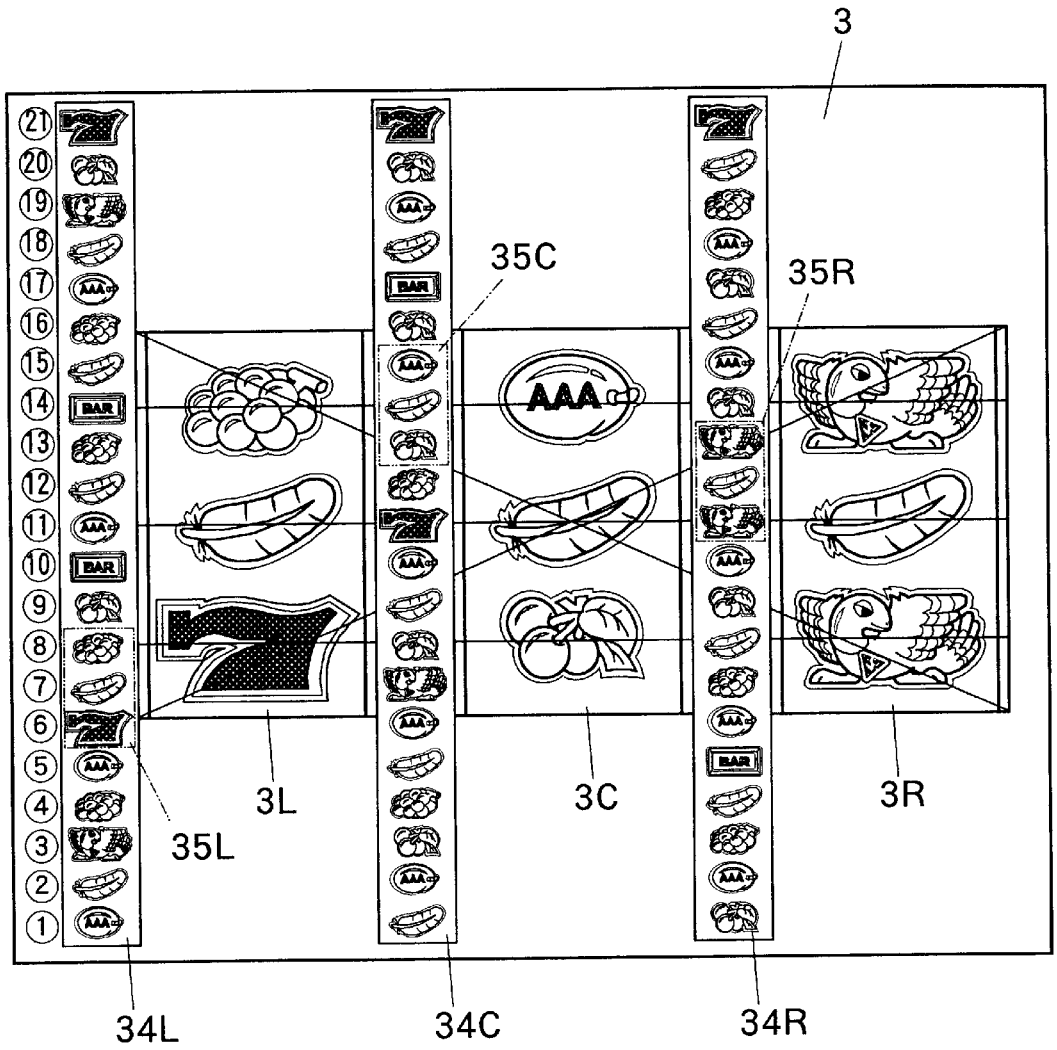
FIG. 7 is an explanatory view for one of support means, i.e., indication of wheels bands.

As seen in FIG. 7, a second embodiment of the support means usable during the game undergoing the Bonus internally determined is indication of wheels bands 34L, 34C, 34R having arrangement of 21 designs and indicated statically at the lefthand side of simulation wheels 3L, 3C, 3R. A technical level is qualified as middle level for 10 games or more and 30 games or less from the achievement of Bonus flag, and a support element of statically indicating the wheels bands 34L, 34C, 34R is chosen. Further, at 31 games or more from the achievement of Bonus flag, the technical level is qualified as beginner level, and such support element is chosen that three indication windows designs 35L, 35C, 35R passing the indication windows 40L, 40C, 40R may be scrolled upwards, synchronized with the wheels 4L, 4C, 4R, in the static wheel bands 34L, 34C, 34R. The scrolled indication windows designs 35L, 35C, 35R may be made noticeable by changing tones of the designs themselves or a background around the designs, or may be distinguished from others by use of framing or lines.

The static wheels bands 34L, 34C, 34R are indicated to show specific arrangement of the designs, so that the aiming operation is made easy. Unless Bonus winning is achieved by use of the feature, movement of three indication windows designs 35L, 35C, 35R, synchronized with the wheels 4L, 4C, 4R, in the static wheels bands 34L, 34C, 34R may be used for the aiming operation. This is warm and kind supports provided stepwise in the order to effectively save or assist beginners, while it does not form a particular unequalness to advance players who can early obtain Bonus winning. The conditions of the number of games when indication of the wheels bands and other features are provided may be changeable or variable.

Figure 8:
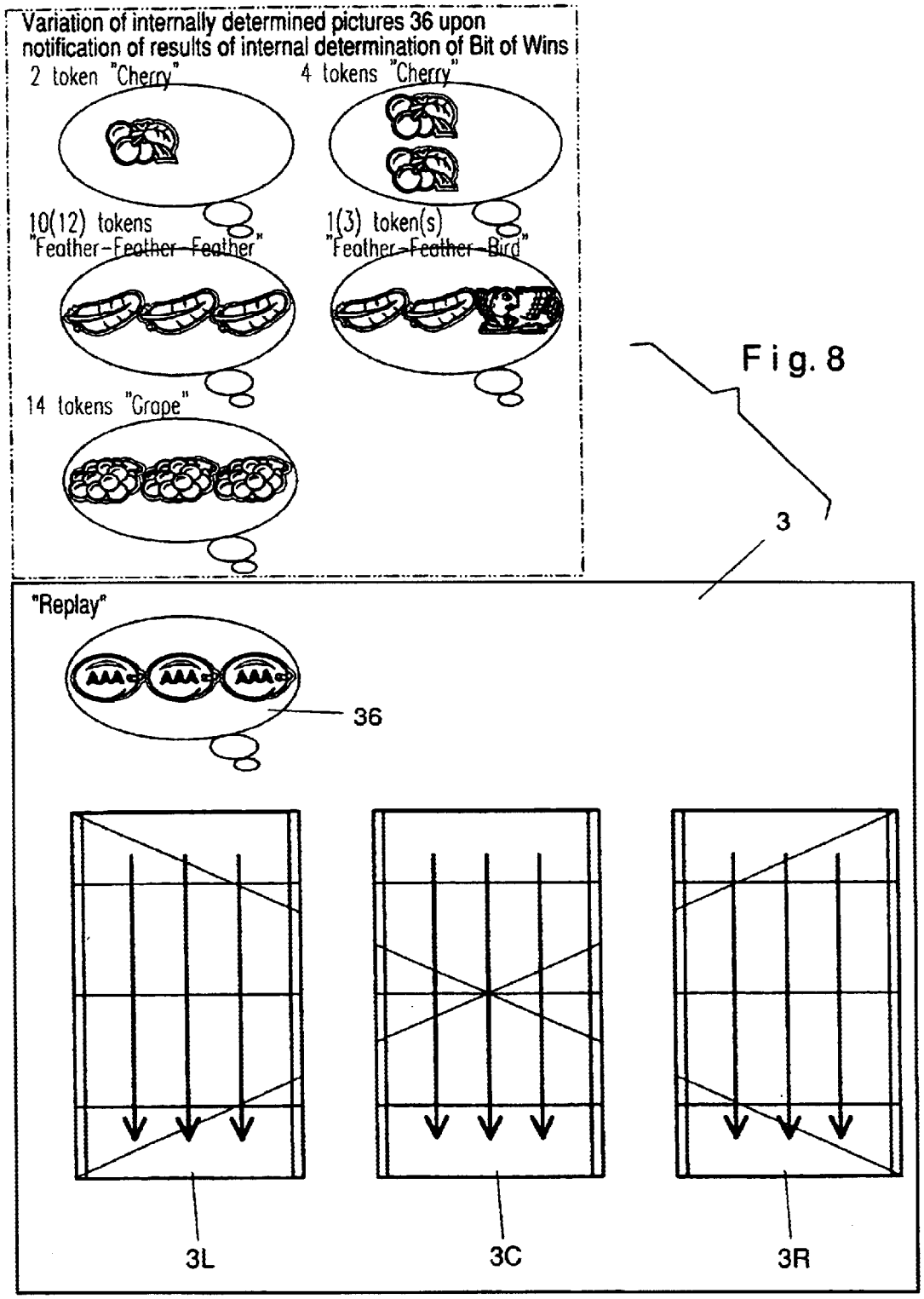
FIG. 8 is an explanatory view for one of support means, i.e., informing results of internal winning determination.

As seen in FIG. 8, a third embodiment of support means during the game undergoes Bonus internally determined is the informing of the achieved flag, i.e., the results of internal winning determination. It is generally equired to grasp that stopped or aligned designs on the wheels 4L, 4C, 4R do or do not form an arrangement being about to become winning, or to foresee it from an informing feature performed by lamps behind the wheels, or the like, in order to understand whether the game undergoes or does not undergo Bonus internally determined. It is difficult for beginners to do such consideration. To distinguish Big Bonus from Regular Bonus is also hard. Hence, at 5 games or more and 15 games or less from achievement of Bonus flag, technical level of players is qualified as a middle-level, and such support element is chosen as informing results of internal winning determination of Bit of Wins.

And at 16 games or more from achievement of Bonus flag, technical level is qualified as beginner level, and such support element is chosen as informing results of internal winning determination regarding all winning styles including Bonus. Such informing is performed in such manner that the start lever 6 is tapped to cause designs 36 subjected to internal winning determination to be shown on the design indication device 3.

After 5 games from internal winning determination regarding Bonus, an internal winning determination result of Bit of Wins is first informed in which game stopping operation can be made to aim at Bit of Wins precedently featured or pulled into, thereby reducing failure in winning such winning style. Besides, provision of the informing enables players to perceive or guess the internal winning determination regarding Bonus, and allows them to concentrate upon aiming at "Red Seven" or "BAR" in a next game in which if there would be no informing of internal winning determination of Bit of Wins. Furthermore, after 16 games or more, results of internal winning determination regarding all winning styles are informed to enable players to perceive the game being engaged in Big or Regular Bonus and concentrate upon aiming, for example, at "Red Seven" in case of Big Bonus.

Accordingly, beginner players can limit designs to be aimed at in the order without useless and reckless stopping operation, whereby being effectively supported. Advanced players, who can early obtain Bonus winning by early perceiving internal determination of Bonus from those aligned designs being about to become winning, or the like, are not subjected to particular unequalness by this feature. When Bonus winning is obtained, informing the internal winning determination results ends. The number of games at which the informing starts or the content to be informed is changed may be changeable or variable. Further, the first informing of internal winning determination regarding Bit of Wins or the later one regarding all winning styles may include or not include Replay. The later informing regarding all winning styles may include or not include distinction between Big or Regular Bonus.

Figure 9:
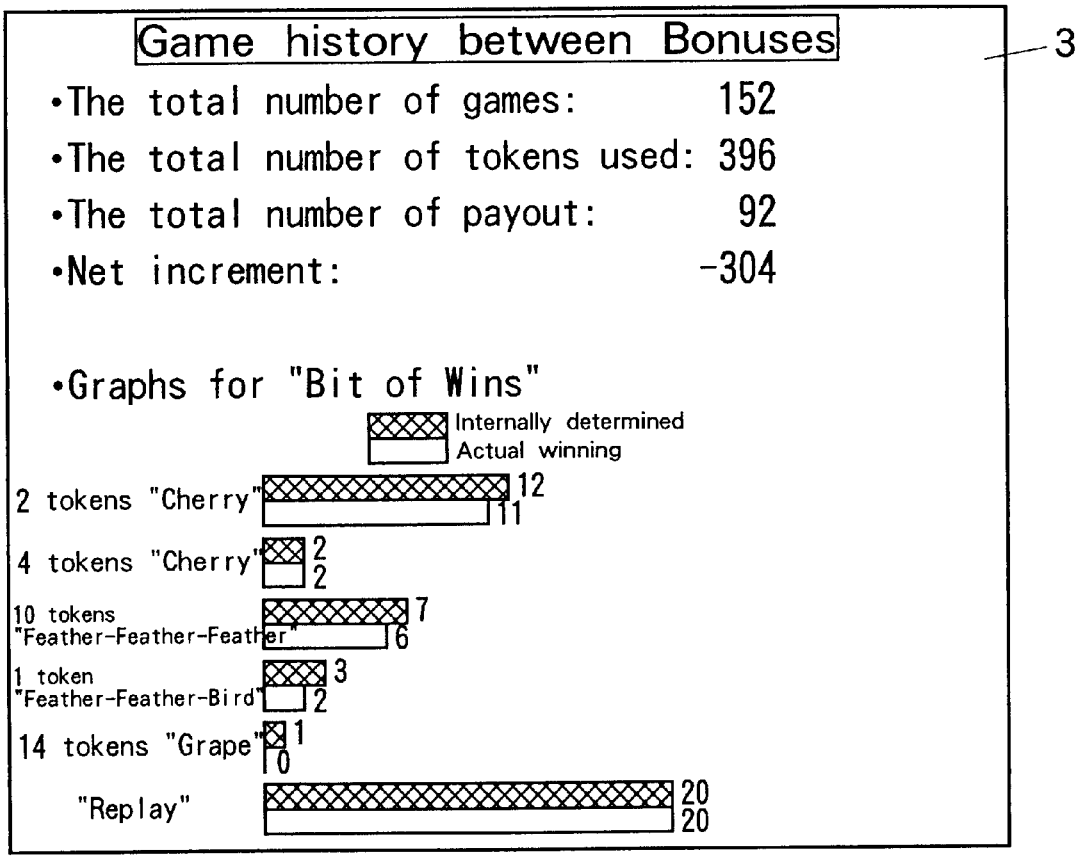
FIG. 9 is an explanatory view for indication of results of games upon winning Bonus.

As shown in FIG. 9, upon Bonus winning, i.e., at the time when the Bonus designs are aligned on the winning lines reaching Bonus winning, the games history from the end of a preceding Bonus game, i.e., a games history between Bonuses, is automatically shown on the image display device 3.

Items shown are the total number of games until Bonus winning, total numbers of coins used and that of those paid during the games, net increment corresponding to difference therebetween, and graphs showing obtaining Bit of Wins winning. It is preferable to provide an initial reset switch, which operated upon start of game, for accurately indicating a game history regarding a single or the same player from start of game to an initial winning of Bonus. It may be in the form of an exclusive button switch or a cursor selection item on the image display device 3. The games history may be shown on a single scene or a plurality of changeable scenes.

After winning Bonus, when a game is started, the image display device 3 returns to the scene of simulation wheels. A game, in case of Big Bonus, starts not with the one-coin betting Jack Game but with ordinary games on three-coins betting basis and with Bit of Wins being obtainable, not like the case of a single Regular Bonus. During the ordinary games in the Big Bonus, the game enters Regular Bonus correspondingly to three Replays alignment, starting Jack Game. Internal probability for entering Regular Bonus maybe high, for example, 1/4.267. That of three "Feathers" alignment, the main Bit of Wins, is made noticeably higher as 1/2.215 with respect to 1/11.394 for ordinary games, and "Feather-Feather-Bird" 1/4.091 with respect to the maximum 1/19.275 for ordinary games. Larger payoff may be provided. Big Bonus ends when three sets of Regular Bonus or 30 times of ordinary games complete.

During Big Bonus, on the image display device 3, similarly to FIG. 7, wheels bands 34L, 34C, 34R and indication windows designs 35L, 35C, 35R are indicated together with the simulation wheels 3L, 3C, 3R. In ordinary games after a first set of Regular Bonus ends, when "Replay" allowing to enter again the Regular Bonus is internally determined, corresponding designs 36 (see FIG. 8) are also shown on the image display. Further, in ordinary games after a second set of Regular Bonus ends, internally determined designs 36 subjected to "Replay" and all of Bit of Winds are also shown on the image display. This support means is applied uniformly to beginners, and advanced players as irrespective of higher or lower technical levels and not by differentiating the players.

In addition to or in place of the uniformly applied support, such feature may be provided that actuation of a support means useful for increasing benefit to be obtained is allowed when provided benefit is few during Big Bonus.

Big Bonus starts, a first three coins betting usual (or ordinary) game has three "Replay" alignment, eight consecutive times of one-coin betting Jack Games receive 15 coins in each game, followed by ending of a first set of Regular Bonus. Then, a second three-coin betting ordinary game had three "Replay" alignment, and similarly, eight consecutive times of one-coin betting Jack Games receive 15 coins in each game, ending a second set of Regular Bonus. In such most rational case, coins payoff is 15*8*2=240, coins used (3+1*8)*2=22, net increment 240−22=218.

Net increment 221 or more means that Bit of Wins are also obtained effectively in the midst ordinary games. Net increment 190 or less means many blanks in the midst usual games or any causes making unable to fully spend a predetermined times of Jack Games. In case of 191 or more and 220 or less, it is assumed that Bit of Wins are not obtained effectively in comparison with the case of net increment 221 or more.

In case that a usual or ordinary game in Big Bonus operation has an internal winning determination regarding "Replay" to enter Regular Bonus, the aiming operation is carried out to intentionally avoid the three "Replay" alignment by use of Replay avoiding technique, and a next game is caused to have three "Feathers" alignment, the main Bit of Wins. Coins used are 3*2 games=6, payoff 12, then net increment 6 is added. Hence, the replay avoiding technique is performed and winning Bit of Wins is included in 30 times of ordinary games, so that increase of coins or tokens to be obtained can be expected.

As seen in FIG. 10, a first example of support means in ordinary or usual games during Big Bonus may be the showing of procedure of Replay-avoiding which is an effective operation in Big Bonus. At 10 or more usual games in Big Bonus with net increment being zero or less before entering a first Regular Bonus, technical level of players is qualified as a beginner level and a middle-level. In such case, when an eleventh game is started, procedure for avoiding "Replay" is indicated on the image display device 3, and there appears an indication (1) that reverse pushing (stop buttons are depressed in the order as right-hand, central and left-hand) is used, and the group of "Bird", "Feather" and "Bird" is aimed at (FIG. 10(A)).

Right-hand stop button 7R is operated to stop right-hand wheel 4R. There appears (2) Do pushing the stop button at random or in an unintentional timing for the central wheel (FIG. 10(B)). It is because "Replay" and "Feather" are ensured, in relation to the arrangement of designs, to be about 100% pulled into. Pushing the stop button at random or in an unintentional timing is the exactly opposite of the precisely aiming technique. The central button 7C is operated to stop the central wheel 4C, and there appears that pushing may be varied for the left-hand wheel correspondingly to the specific winning styles. And patterns being about to become winning and designs to be aimed are shown (FIG. 10(C)). The feature shown in this example can be carried out easily for avoiding "Replay" with the upper winning line because of an enough number of designs.

When three "Replay" alignment is not achieved due to the avoiding technique in case that "Replay" has been internally determined, there appears an indication of "success in avoiding "Replay" (FIG. 10(D)). Also, when the Replay avoiding technique is carried out, in case that actually "Replay" has not been internally determined while "Feather-Feather-Feather" or "Feather-Feather-Bird", the Bit of Wins, is internally determined, such Bit of Wins may be automatically achieved (FIG. 10(E)).

The condition for showing the Replay avoiding procedure is 10 or more usual games before entering a first Regular Bonus, and net increment zero or less. This is because of assumption of such case that Replay avoiding has been performed to some extent but coins increment is not seen due to poor operation and is foreseen to largely lower in comparison with the time not performing the Replay avoiding. Correcting misunderstanding and teaching an effective procedure could prevent players from losing benefit to be inherently enjoyed by them. The specific conditions that the procedure is shown may be changeable or variable. Explanation of the avoiding procedure in lump may be shown other than the navigation style of dialogue in association with stopping operation of the stop buttons.

A second example of support means in usual or ordinary games during Big Bonus may be the allowing setting of aiming maker 30 at desired designs of simulation wheels 3L, 3C, 3R similarly to those explained in the first embodiment of support means with Bonus internally determined, i.e., FIG. 6. For example, when no Regular Bonus has been spent in the state less than 10 remaining usual or ordinary games during Big Bonus, technical level of players are qualified as beginner level and middle-level, in which case the setting of aiming marker is allowed in the eleventh game and those thereafter.

In the case that the support is applied, players focus on performing Replay avoiding technique and obtaining Bit of Wins, but not spend a predetermined sets of Regular Bonus to have a high possibility of self-destruction. Players tending to get engrossed in Replay avoiding technique often fall into such circumstances to obtain only less number of coins. The aiming marker 30 is, as similarly to normal pushing DDT technique enabling avoiding three "Replay" alignment and failure in winning all Bit of Wins, set for example at "BAR", code number 10, on the left-hand wheel. By this, maximum recovery can be facilitated in the remaining games with the aiming capacity being assisted, thereby enabling benefit to be inherently obtained to be reduced as less as possible. The conditions of the number of games, etc., with which the marker 30 is allowed of setting may be changeable and variable.

Figure 11A:
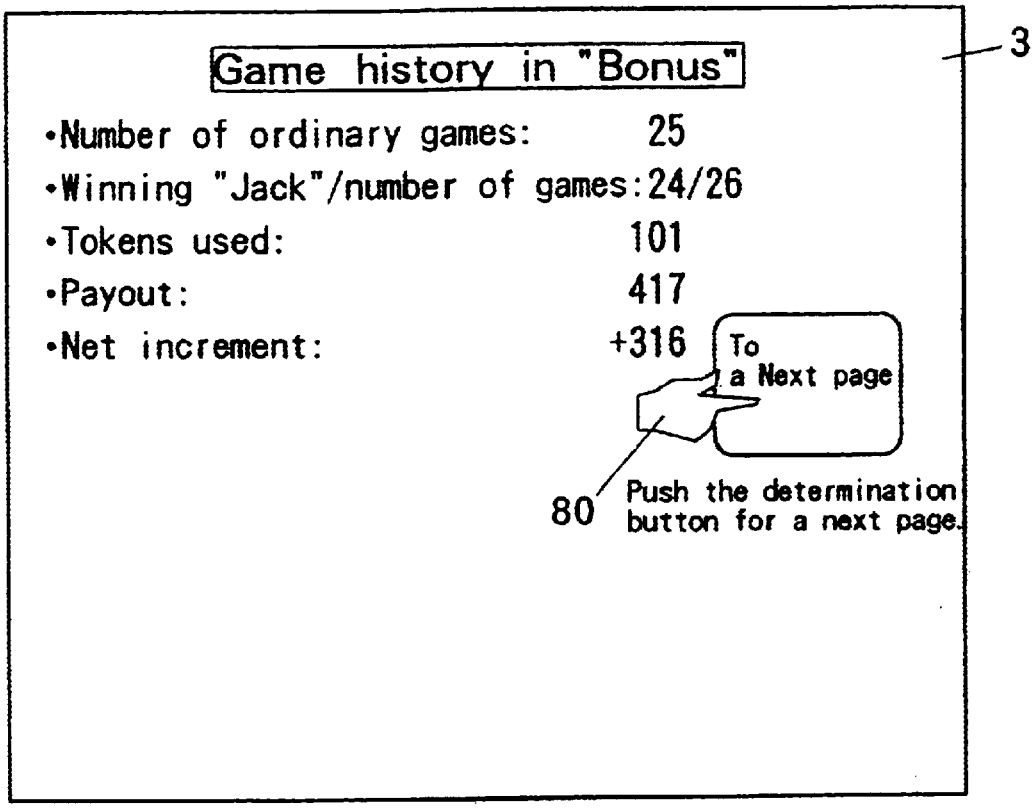
FIG. 11 is an explanatory view for indication of results of games upon end of Bonus.
Figure 11B:
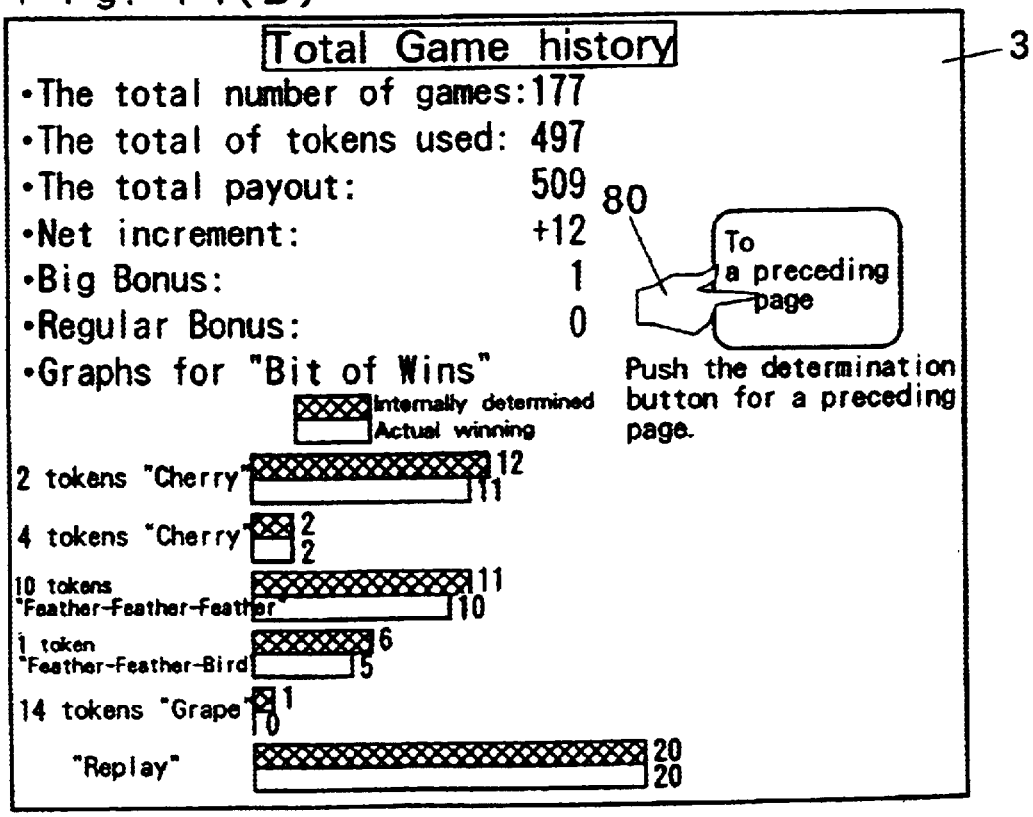

As seen in FIG. 11, upon end of Big Bonus, a games history (A) during Big Bonus and a total games history (B) are shown on the image display device 3 by changing the scenes.

Items to be shown in the games history during Big Bonus are numbers of ordinary games, winning Jack Games and number of games, coins used, payoff and net increment. Those shown in the total game history are total number of games, total of coins used, total payoff, net increment, Big Bonuses, single Regular Bonuses (except those in Big Bonus) and graphs of winning Bit of Wins.

After Big Bonus ending, players play again usual or ordinary games, expecting to win Bonus again. To win Bonus, it is preliminarily required to cause Bonus to be subjected to internal winning determination by drawing lots regarding random numbers on the basis of specific random numbers taken by tapping the start lever 6, which is controlled by accidental occurrence. Hence, there may happen a series of consecutive chances in a short time leading to Big Bonus, or unfortunately happening no occurrence of Bonus determination for a long time. The feature is particularly effective in such unfortunate situation to make failure in winning Bit of Wins as little as possible.

A support means useful for aligning any winning designs (in relation to the internal winning determination) on the winning lines is allowed of its actuation when Bonus is not achieved again after a predetermined number of games from end of a preceding Bonus. A first example of this support means in ordinary games is that support is not applied until 300 games after end of Bonus, and in case of 301 games or more and 600 or less, technical level is temporarily qualified as a middle-level, in which case such support is chosen that when two or four tokens Cherry has been internally determined, a corresponding design 36 is indicated on the image display device 3 similarly to FIG. 8. In case of 601 games or more, technical level is temporarily qualified as a beginner level, in which case such support is chosen that when 10 tokens "Feather" -"Feather"-"Feather" and one token "Feather"-"Feather"-"Bird" have been internally determined, a corresponding design 36 is shown.

By this feature, players undergoing bad luck are applied stepwise with kind and careful supports, so that this advantageously enables beginners or middle-grade players to make less failure in winning Bit of Wins while allowing advanced players (who are able to carry out DDT method) to be mitigated in performing strictly the aiming operation. The conditions of number of games at which the internally determined design 36 is shown, and Bit of Wins subjected to indication of internally determined designs, may be changeable or variable.

A second example of support means usable in ordinary game may be that when the number of games after end of Bonus becomes 500 or more, technical level of players is temporarily qualified as a beginner level/a middle-level, in which case there causes indication of wheels bands 34L, 34C, 34R similar to FIG. 7. Indication windows designs 35L, 35C, 35R are not scrolled. By this feature, the arrangement of designs can be clearly seen to enable players to reduce failure in winning Bit of Wins. The conditions such as the number of games may be changeable or variable. The indication windows designs 35L, 35C, 35R may be scrolled also.

Figure 13:
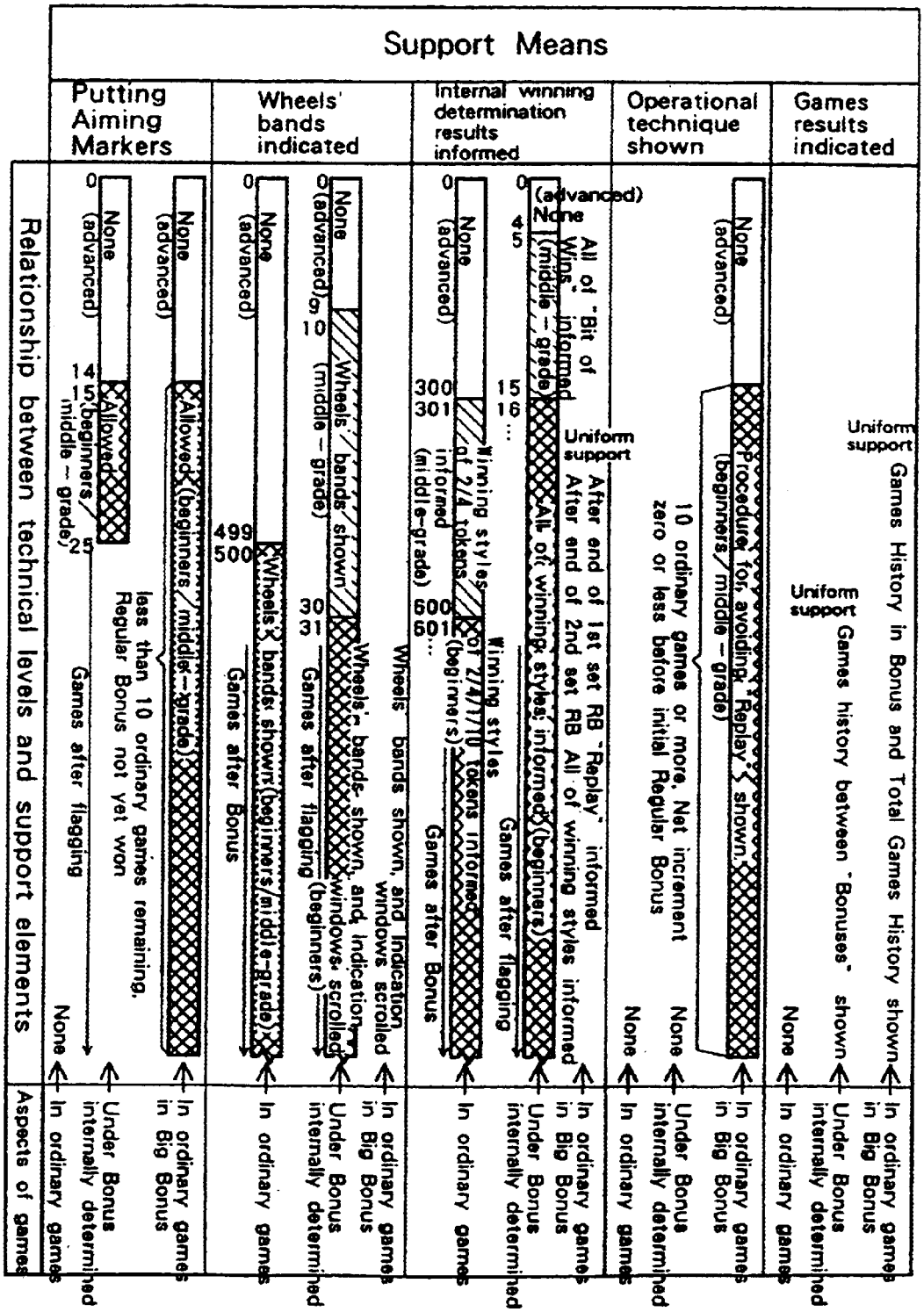
FIG. 13 is a table showing relationship between technical levels and support elements with respect to specific support means.
Figure 14:
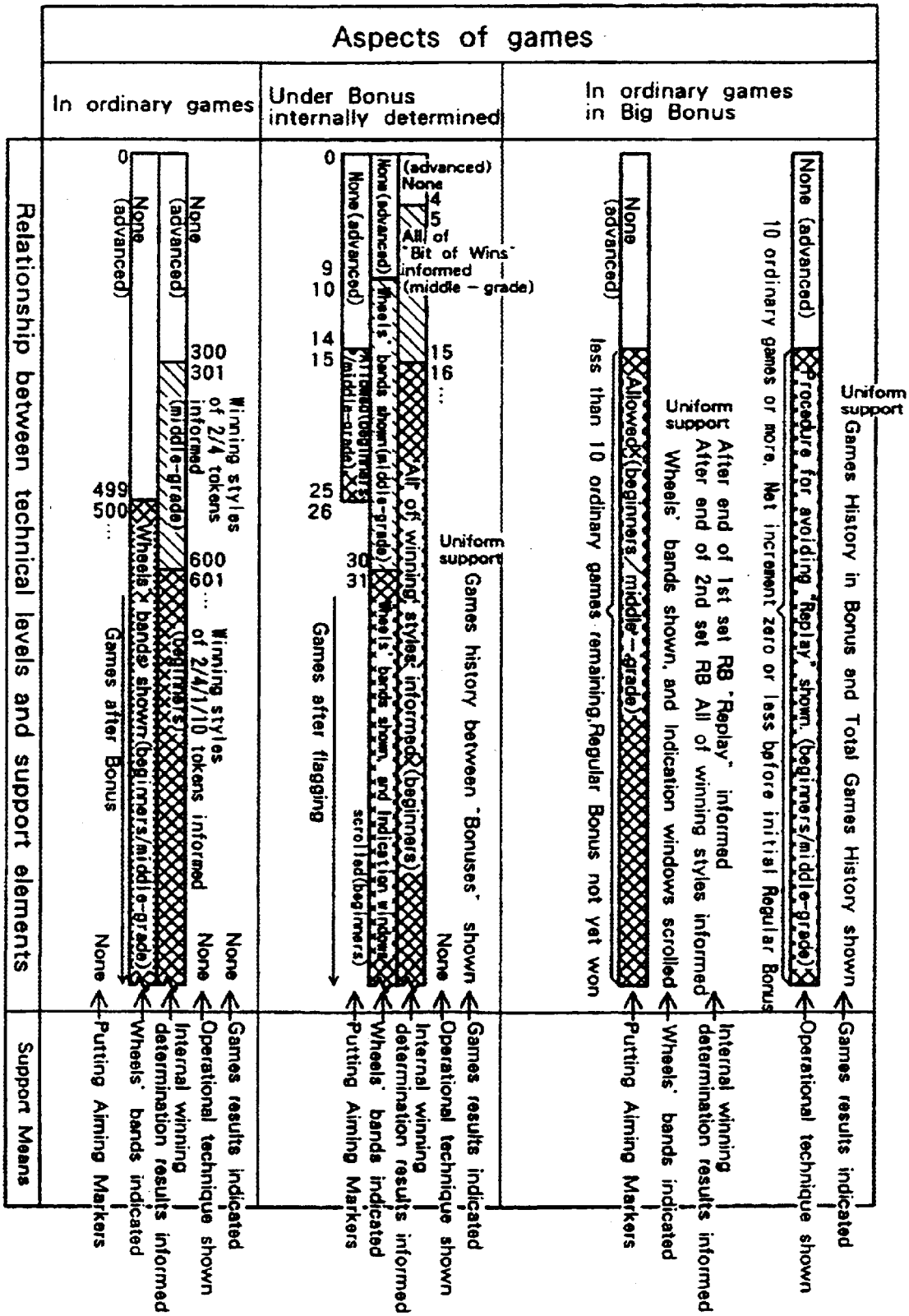
FIG. 14 is a table showing relationship between technical levels and support elements with respect to specific aspects of games.

As seen in FIG. 12, the support means as foregoing are as seen in the table. The support means may be used solely or in combination freely. Table in FIG. 13 shows relationship between technical levels (advanced, middle and beginners level) and support elements (supporting high stepwise correspondingly to the technical levels) with respect to specific support means, based on the support means to be allowed of actuation on the basis of technical levels and taken from Table in FIG. 12. FIG. 14 is re-arrangement of the table in FIG. 13 featuring mainly the aspects of the games. As seen in FIGS. 13 and 14, players are provided with suitable supports correspondingly to their technical levels by use of and in the support means and games aspects.

Figure 15:
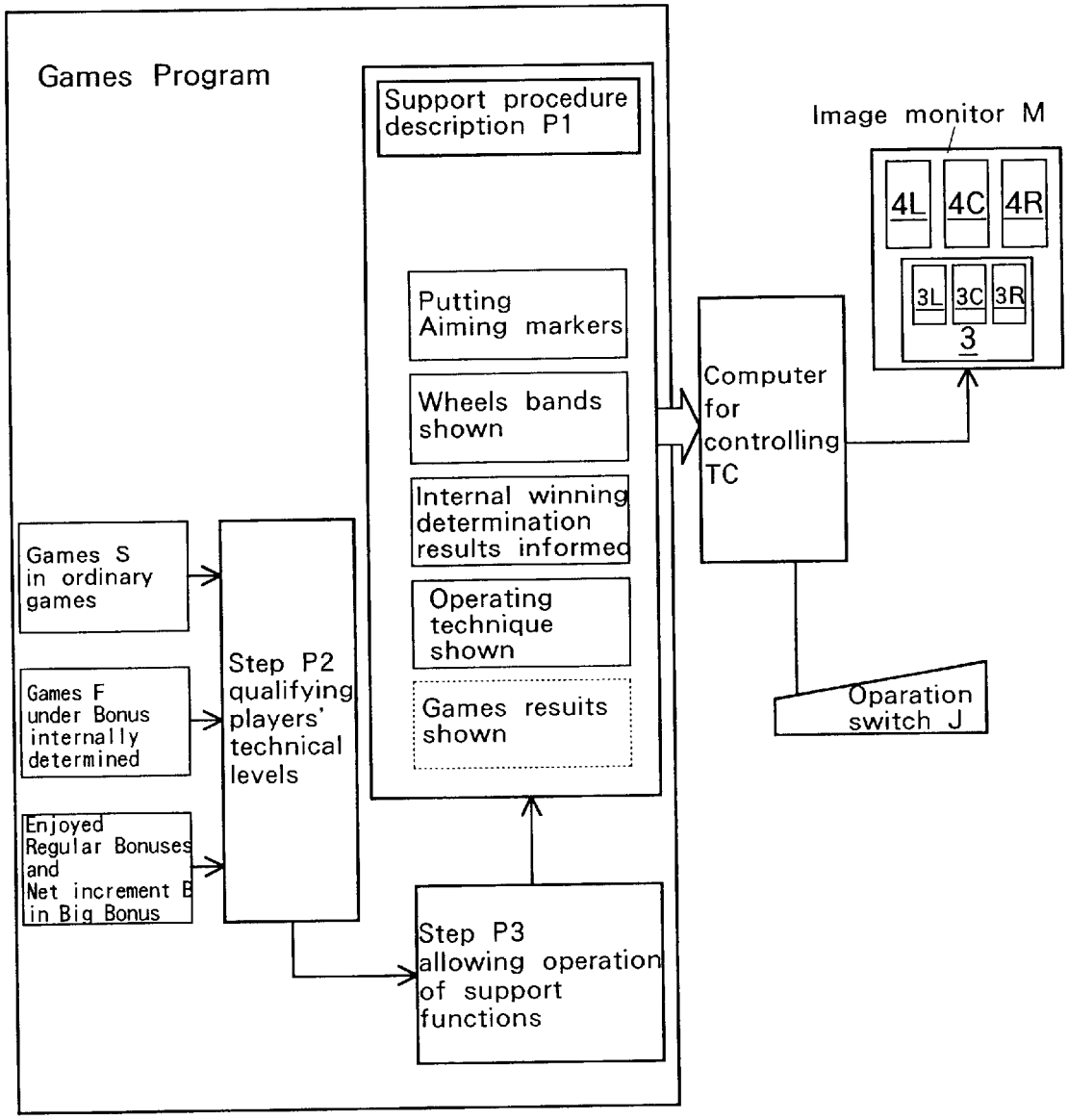
FIG. 15 is an explanatory view for structure of a first embodiment of the game program.

FIG. 15 shows a structure of program for a simulation game memorized in a medium readable by a computer such as a compact disc or ROM cartridge. The program is provided with a support function disposing procedure description P1, which describes regarding aiming marker setting, wheels bands indication, internal winning determination results informing, operational procedure showing, and games history indication, each useful for favouring players and supporting players correspondingly to their technical levels, the contents of the supports being as forgoing. The program further includes a technical level qualifying step P2, which monitors the number S of games in ordinary games in a latest game history going back from a latest time, the number of games F with Bonus being internally determined, the number of spent Regular Bonus during Big Bonus and net increment B, and qualifies on the basis of those the technical levels of players, and an allowing step P3 for allowing actuation of the support functions on the basis of the qualified technical levels.

Through a control computer TC such as a television game controller or a personal computer, the main wheels 4L, 4C, 4R and simulation wheels 3L, 3C, 3R on the image display device 3 are shown on an image monitor M such as a household television or a display of a personal computer. The start lever, stop buttons etc., may employ an operating part accompanied with the television game controller or an operation switch J such as keyboard of a personal computer.

Figure 16:
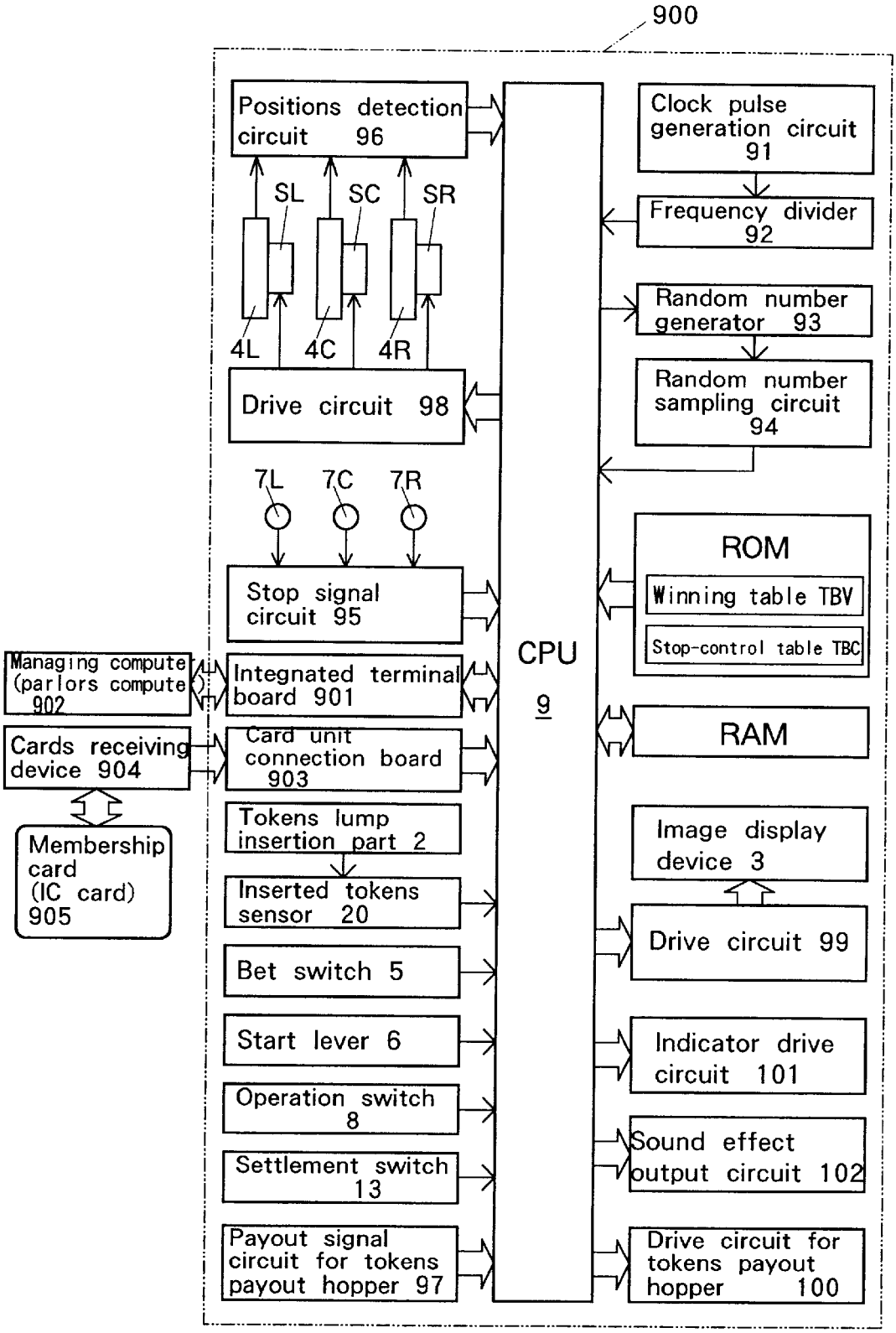
FIG. 16 is a block diagram of control for a second embodiment of the game device.

FIG. 16 is a block diagram of control of a second embodiment of the game device wherein technical level of players are qualified correspondingly to specific points values recognized from records in the individual games history recording means comprising a membership card 905 made of IC card.

The control device 900 housed in the game machine body 1 is basically the same as of FIG. 5 except that the control device 900 is connected with a management computer 902 comprising a parlor'computer through integrated terminal board 901 and is also connected with a card receiving device 904, which provided on a sandwiched part between machines or at an upper panel of collectively provided machines, through a card unit connection board The card receiving device 904 is given access from the membership card 905. The card receiving device 904 may otherwise be connected to the management computer 902.

As shown in FIG. 17, the membership card 905 records a membership'ID, and various information such as personal information as players' sexes, ages, residential areas; information showing use degree of game days using the game, total games, total Big Bonus achieved, each updated upon returning the card on the end of the game, and information relating to games technical levels as payoff (gain)/use ratio that is a ratio of coins paid-out with respect to coins used, and average obtained coins per Big Bonus, similarly updated upon returning the card.

Specific values of those records form weight in the points values with which there are decided qualifying the technical levels and allowing actuation of the support means. For women, not like the case of men, weight plus 1 is added uniformly to those for beginners and middle-grade players among the support elements forming the support means. For aged persons, a larger weight is applied to the points values of the support means for beginners and middle-grade players. By contrary, for men and young persons, weight is applied to the points values of those for advanced players. players whose residential areas are nearer the parlor have a possibility of becoming customers and are given a certain weight.

When the information showing use degree of the game, such as days using the game, total games, total Big Bonuses achieved is higher, weight in the points values of the support means is increased. When the information relating technical levels of the game such as gain/use ratio, average obtained tokens per Big Bonus is higher, negative weight is applied to the points values of the support elements for beginners and middle-grade players, while positive weight to the points values of those for advanced players. For players in case that the gain/use ratio is extremely low, negative weight is added to the points values of support elements for advanced players.

To each support element of the support means, i.e., to each vertical line in the Table shown in FIG. 17, weight is added and collected to provide the specific "Points" Pb, Pc, Pd, Pe, and Pf on the basis of which actuation of the support elements are allowed or not allowed. The Points and weight which is basis of the Points may be recorded directly in the membership card 905 to be managed. Otherwise, the membership card 905 may have records only of values of the "Items recorded" or only of membership ID, while Points and wight may be managed in the card receiving device 904, control device 900 of game machine body 1, or management computer 902 to associate with input of the membership card 905.

The reference values to be compared with the Points values may be changeable by the parlors by use of an input switch separately provided at the control device 900 or management computer 902. When the Points is over the reference values, the support is automatically applied. Otherwise, a support selection switch separately provided at the game device body 1 may be first made valid when the Points is over reference values, so that player can operate the selection switch for actually receiving the supports.

A first example of support means for beginners and middle-grade players in the second embodiment of the game device is allowing or permission of setting an aiming marker 30 at a desired design on the simulation wheels 3L, 3C, 3R similarly to FIG. 6. When Points Pb corresponding to the aiming marker setting is 3 or more, reference values, in ordinary games, 2 or more under Bonus internally determined, and 1 or more in the ordinary games in Bib Bonus, the technical level is qualified as beginner level/middle-level (see FIG. 18) and the support similar to the above is applied.

Figure 19:
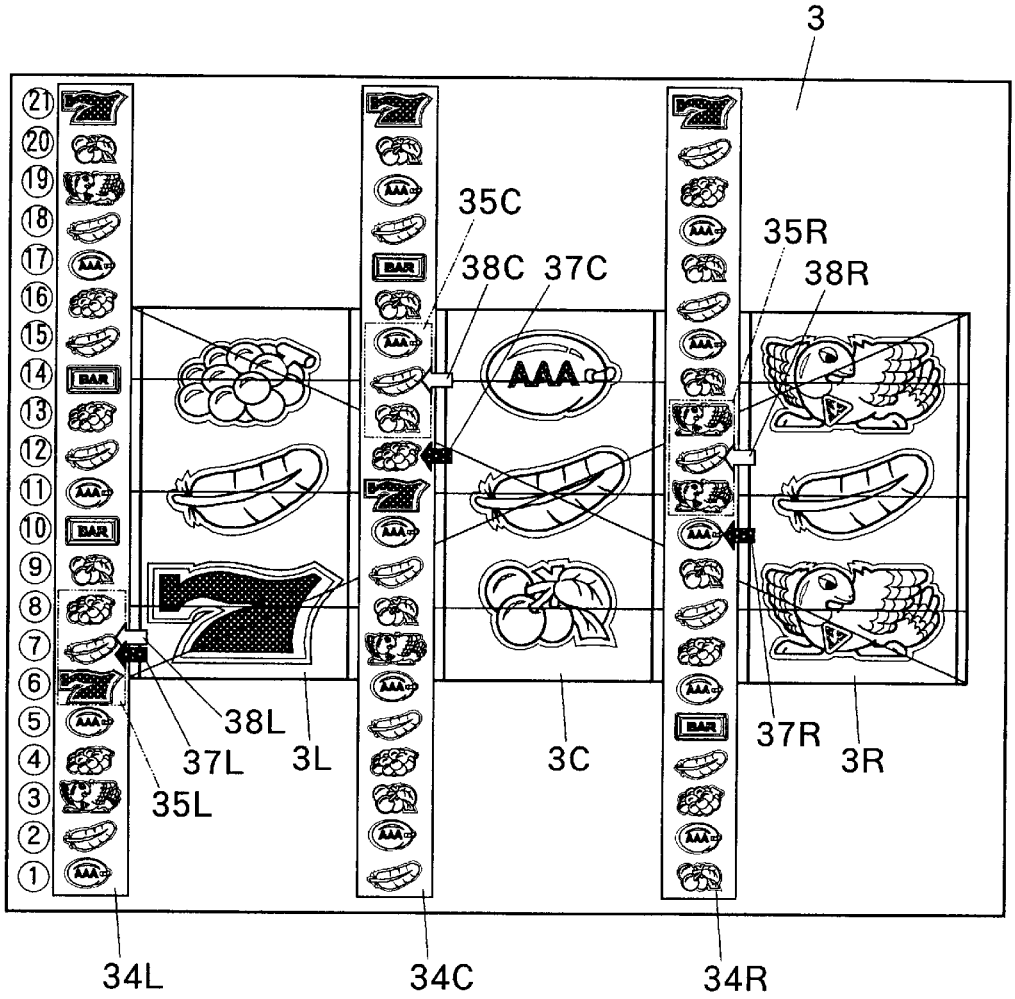
FIG. 19 is an explanatory view for indication of wheels bands in the second embodiment of the game device.

As seen in FIG. 19, a second example of support means for beginner and middle-grade in the second embodiment of the game device is indication of wheels bands 34L, 34C, 34R clarifying arrangement of 21 designs laterally of and at the left-hand of simulated wheels 3L, 3C, 3R. The support is similar to FIG. 7. When Points Pc corresponding to the wheels bands indication is 4 or more, reference values, in ordinary games, 3 or more under Bonus internally determined, and 6 or more in the ordinary games in Bib Bonus, the technical level is qualified as middle-level (see FIG. 18), the support element statically showing the wheels 34L, 34C, 34R is chosen.

When Points Pc corresponding to the wheels bands indication is 6 or more, reference values, in ordinary games, 4 or more under Bonus internally determined, and 7 or more in the ordinary games in Big Bonus, the technical level is qualified as beginner level (see FIG. 18), such support element is chosen that indication windows designs 35L, 35C, 35R passing indication windows 40L, 40C, 40R are scrolled upwards in the static wheels bands 34L, 34C, 34R as synchronized with movement of the wheels 4L, 4C, 4R.

Indication of the static wheels bands 34L, 34C, 34R clarifies the arrangement of the designs to enable players to readily perform the aiming operation. In case this is not enough for the purpose, the indication windows designs 35L, 35C, 35R which moves in the static wheels bands 34L, 34C, 34R as synchronized with wheels 4L, 4C, 4R can be relied on in the aiming operation. Hence, beginners are applied orderly stepwise with careful and kind supports to be saved effectively.

For advanced players who have not higher values in the Points Pc corresponding to wheels bands, when Points Pc corresponding to the wheels bands indication is 2 or less, reference values, in ordinary games, 2 or less under Bonus internally determined, and 3 or less in the ordinary games in Bib Bonus, the technical level is qualified as advanced level (see FIG. 18), such support element is chosen that wheels bands 34L, 34C, 34R are shown after stopping operation by the stop buttons 7L, 7C, 7R, and shown in the wheels bands are marks 37L, 37C, 37R of stopping operation positions related to operation of stop buttons, and marks 38L, 38C, 38R indicating actual stop-positions. By this, accuracy of the aiming is clarified to provide advanced players with materials for estimating technique, serving as a support for the advanced players.

Figure 20:
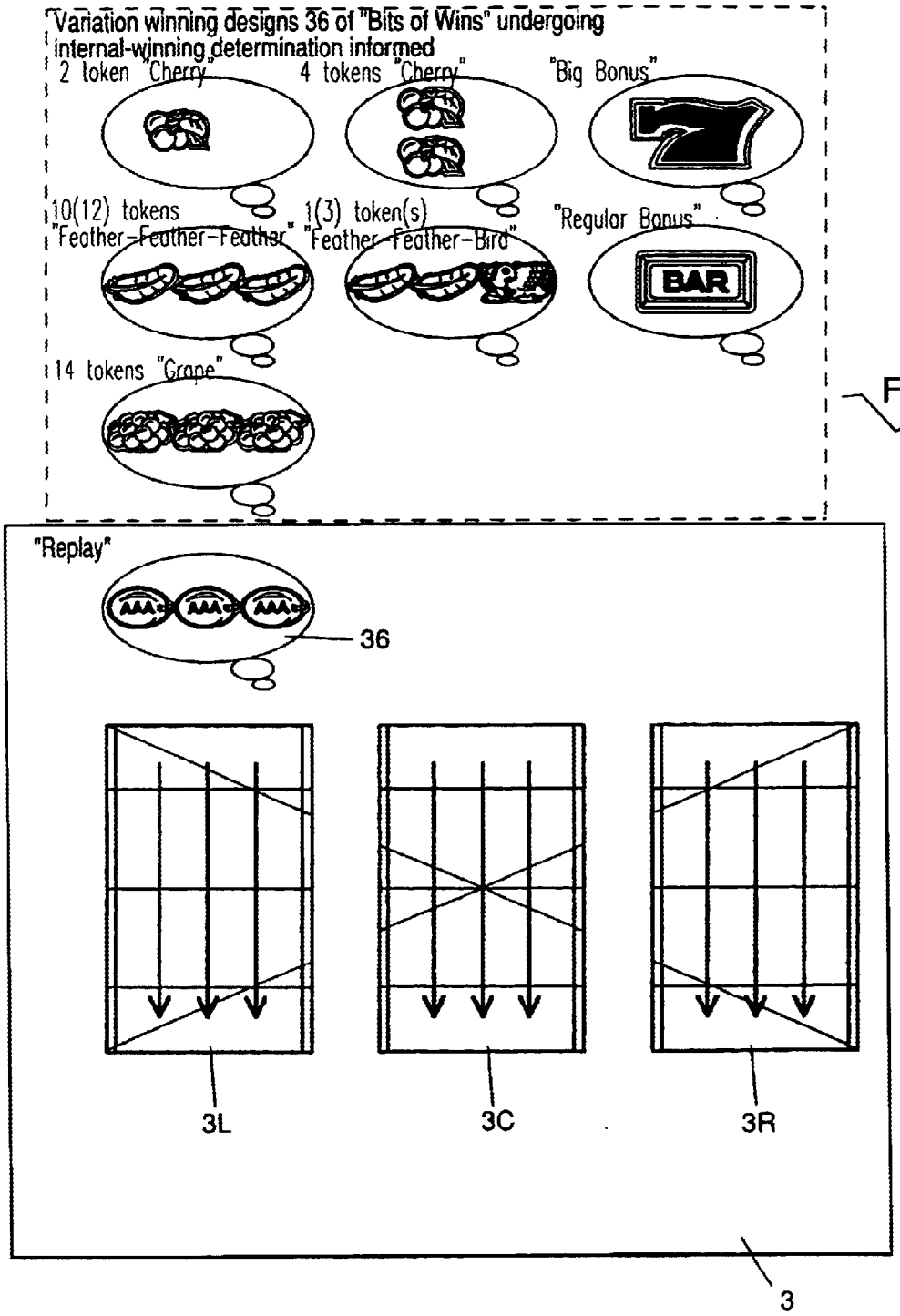
FIG. 20 is an explanatory view for informing the internal winning indication results in the same second embodiment.

As seen in FIG. 20, a third example of support means for beginner/middle-grade in the second embodiment of the game device is the informing of achieved flag, i.e., results of internal winning determination, which support is similar to FIG. 8. When Points Pd corresponding to the informing of results of internal winning determination is 5 or more, reference values, in ordinary games, and 5 or more under Bonus internally determined, the technical level is qualified as middle level (see FIG. 18), such support element is chosen that results of internal winning determination of Bit of Wins and Replay are informed.

When the Points Pd is 1 or more, reference value, in the ordinary games in Big Bonus, internal winning determination results only of Bit of Wins is informed, and when 2 or more, the same results including also "Replay" informed. Moreover, when Points Pd corresponding to the informing of results of internal winning determination is 8 or more, reference values, in ordinary games, and 8 or more under Bonus internally determined, the technical level is qualified as beginner level (see FIG. 18), such support element is chosen that results of internal winning determination of all winning styles including Bonus are informed. In Big Bonus operation, Bonus is not subjected (as overlapping) to internal winning determination, so that there is no scene of informing of Bonus. The informing is performed in such manner that after the start lever 6 tapped, internally determined designs 36 are indicated on the image display device 3.

By the feature, stopping operation can be performed after limiting an aimed design, thereby enabling beginner players to prevent from making stopping operation in vain, effectively supporting the beginner players. In addition, advanced players who can perceive internal winning determination results from informing by the lamps behind the wheels, or from a specific pattern of designs on the wheels to be about to achieve winning would not be subjected to a particular unequalness. Informing the Bonus designs may be made in a single form of "Bonus internally determined" commonly taken for Big and Regular without separating them.

A fourth example of support means for beginner and middle-grade players in the second embodiment of the game device is indication of the Replay avoiding technique which is a useful operational procedure in Big Bonus. When Points Pe corresponding to Replay avoiding technique indication is 2 or more, reference value, in the ordinary games in Big Bonus, technical level is qualified as middle level and such support is chosen as indicating the Replay avoiding procedure the contents of which are as foregoing.

Figure 21:
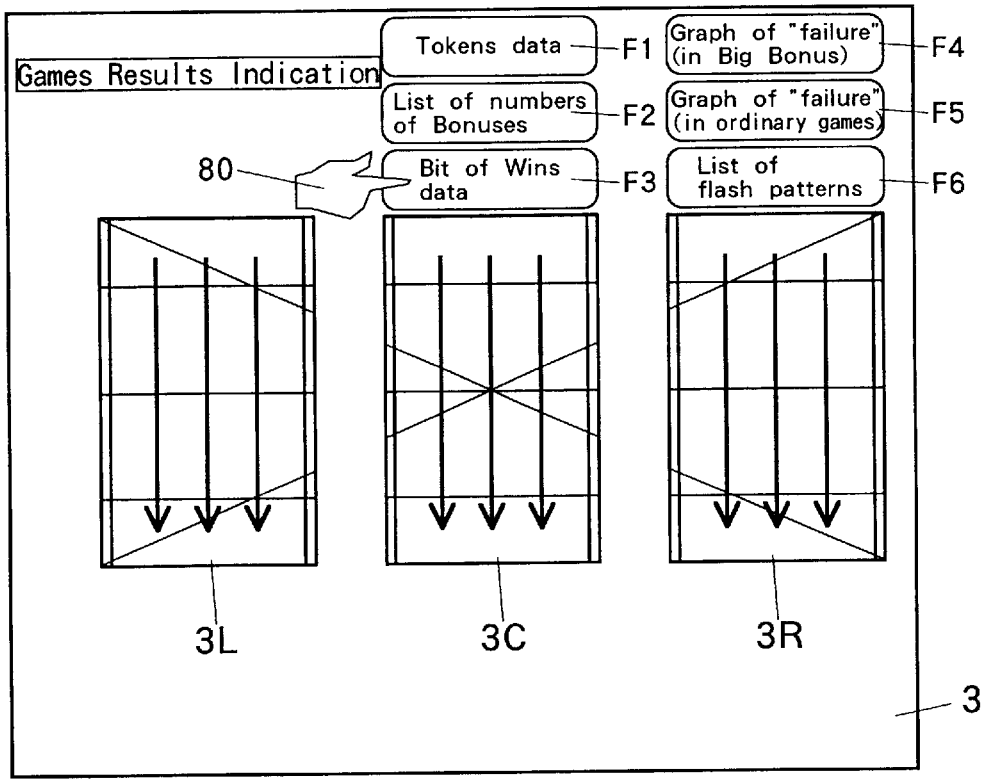
FIG. 21 is an explanatory view for indication of games results in the same second embodiment.

As seen in FIG. 21, an example of support means for advanced players in the second embodiment of the game device is the allowing of indication of games results useful for estimating the game. Subdivided support elements of the games history indication include or correspond to tokens data, list of number of Bonuses, Bit of Wins data, graph of "failure" (in Big Bonus), graph of "failure" (in ordinary games) and flash patterns list, each having specific reference values (see FIG. 18).

When Points Pf corresponding to the games results indication is over the reference values, selection fields F1, F2, F3, F4, F5, F6 of the subdivided support elements showing values higher than the reference values are lit on the image display device 3, and a cursor 80 is set on them with the decision button 85 being depressed, so that the contents of those data can be seen. Advanced players have many selection fields shining as decoration and can feel superior to others. The reference values of the support elements for the games result indication do not relate to the games aspects such as in ordinary games, under Bonus internally determined or in the ordinary games in Big Bonus.

Figure 22:
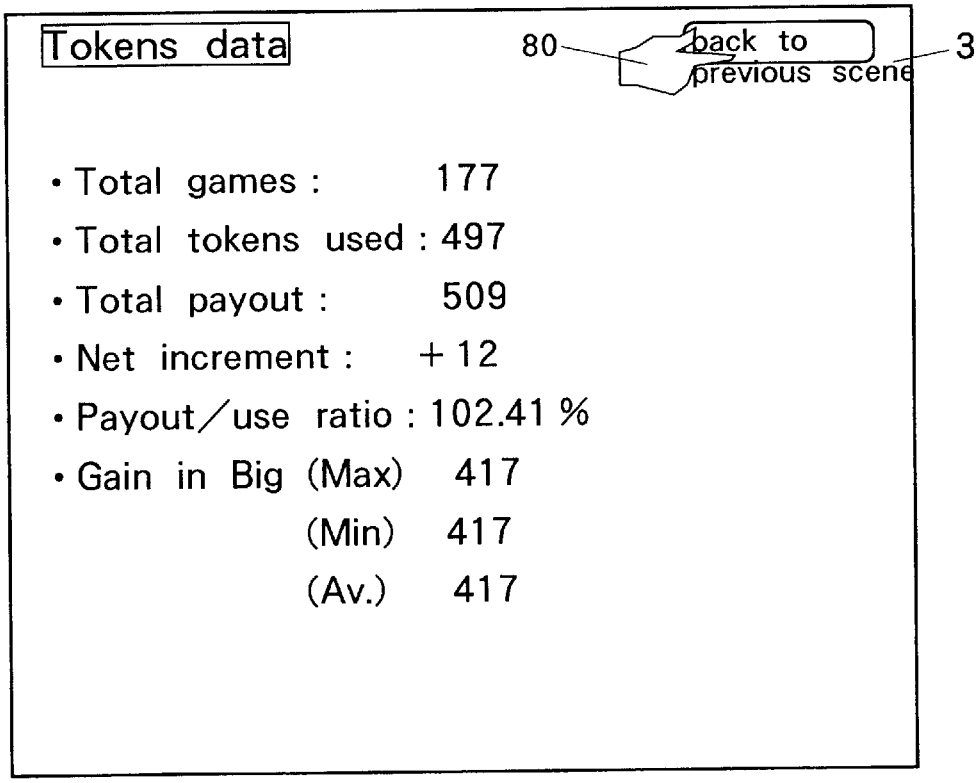
FIG. 22 is an explanatory view for indication of tokens data in the games results indication in FIG. 21.

As seen in FIG. 22, the tokens data shown when the Points Pf corresponding to the games results indication is 3 or more, reference values, include total games, total tokens used, total payoff (or pay-out), net increment (the difference between total tokens used and total payoff), payoff (or gain)/use ratio, maximum gain per Big Bonus, minimum gain per Big Bonus, and average gain per Big Bonus. Decision button 85 or cancel button 86 may be depressed for the scene of FIG. 21.

Figure 23:
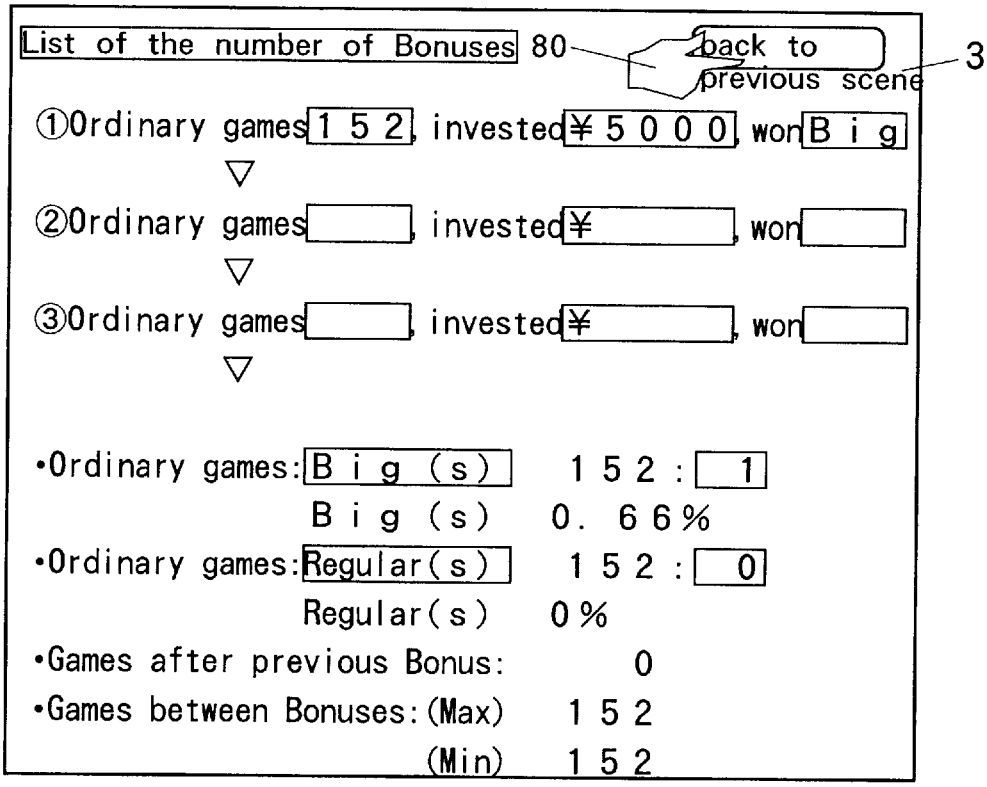
FIG. 23 is an explanatory view for indication of a list of the number of Bonuses in the games results indication.

As shown in FIG. 23, included in the List of the number of Bonus shown when the Points Pf is 4 or more, are a past personal history including a set of the number of ordinary games, money used, and kinds of Big or Regular until winning Bonus, total Big Bonus with respect to total of ordinary games, Appearance ratio (the ratio of total Big Bonus and total of ordinary games), total of Regular Bonus with respect to total of ordinary games, appearance ratio (the ratio between the total of Regular Bonus and total of ordinary games), the number of ordinary games after a preceding Bonus, and maximum and minimum numbers of games between Bonuses. When the past history has many data and be not shown in one scene, the scene may be changed by the cursor 80 and decision button 85.

Figure 24:
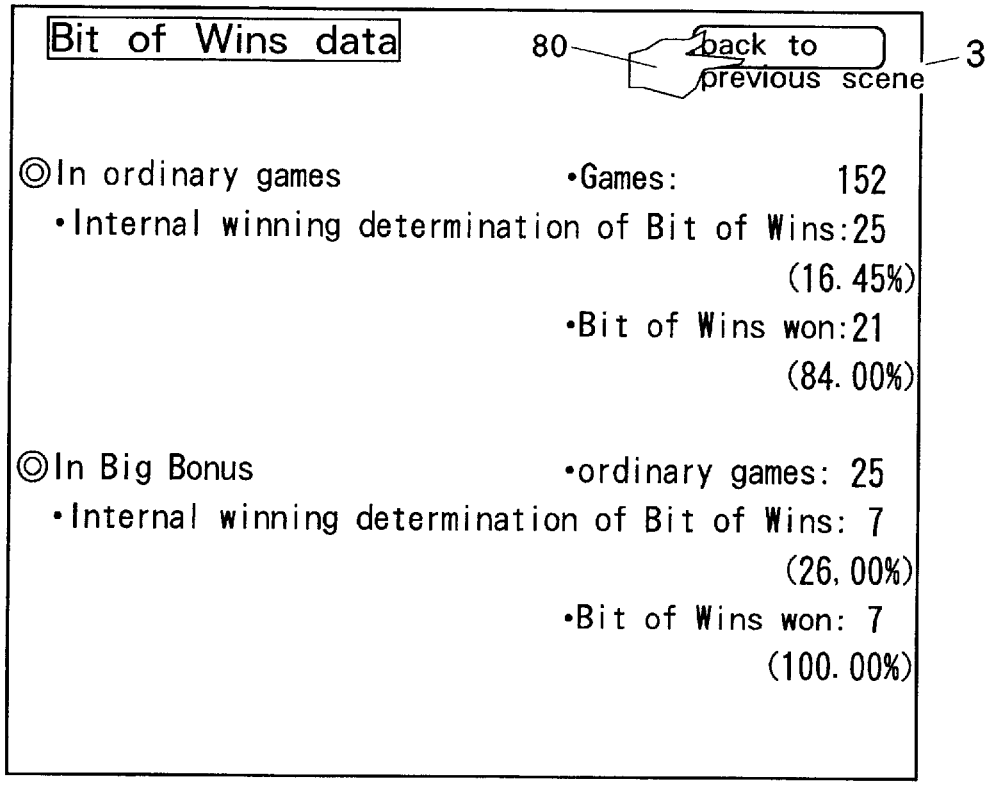
FIG. 24 is an explanatory view for indication of data of Bit of wins in the games results indication.

As seen in FIG. 24, Bit of Wins data which is shown when Points Pf is 5 or more includes total of games in ordinary games, the number of internal winning determination of any Bit of Wins achieved in those games, and appearance ratio of internal determination, the number of winning Bit of Wins and the ratio of winning, and total of games in ordinary games in Big Bonus, the number of internal winning determination of any Bit of Wins achieved in those games, and appearance ratio of internal determination, the number of winning Bit of Wins and the ratio of winning.

Figure 25:
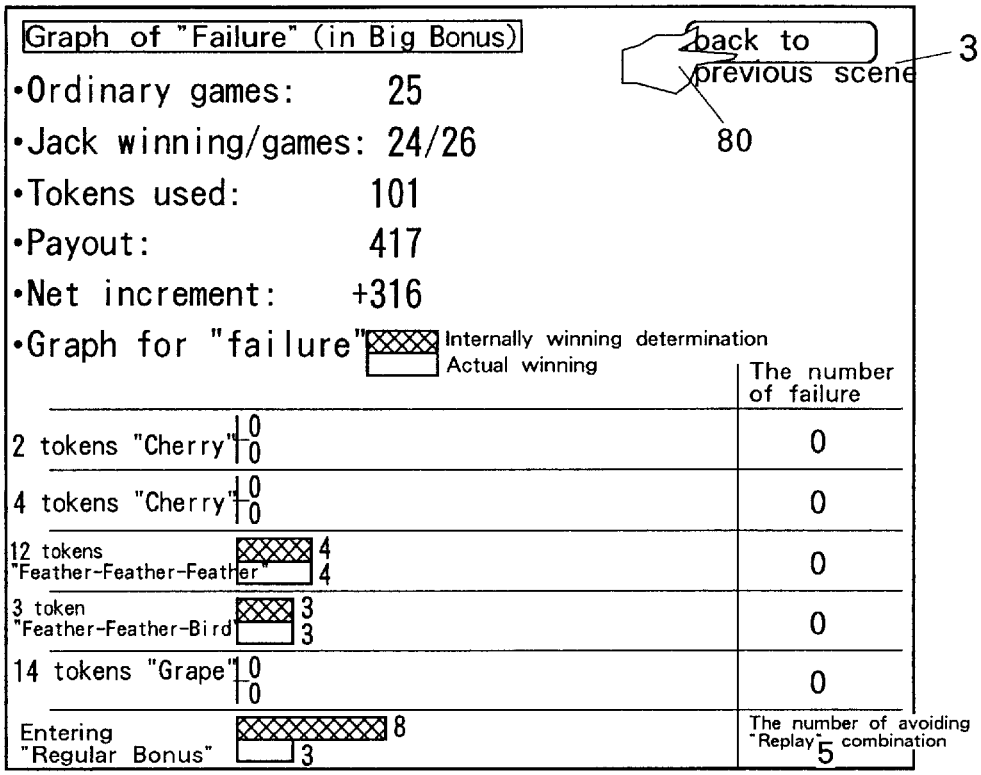
FIG. 25 is an explanatory view for indication of graph of "Failure" (in Big Bonus) in the games results indication.

As seen in FIG. 25, graph of "failure" (in Big Bonus) which is shown when the Points Pf is 5 or more includes the number of ordinary games on the three-coins betting basis, the number of winning of Jack Game on one-coin betting basis and the number of games, coins used and payoff, net increment (difference between coins used and payoff), and a table showing the number of internal winning determination, the number of winning, and the number of failure of specific winning styles. Failure in winning Replay to have entering Regular Bonus and starting Jack Game relates to the number of success of the Replay avoiding operation. The values may be cumulative over preceding plural times of Big Bonus or otherwise be shown on each scene for each Big Bonus.

Figure 26:
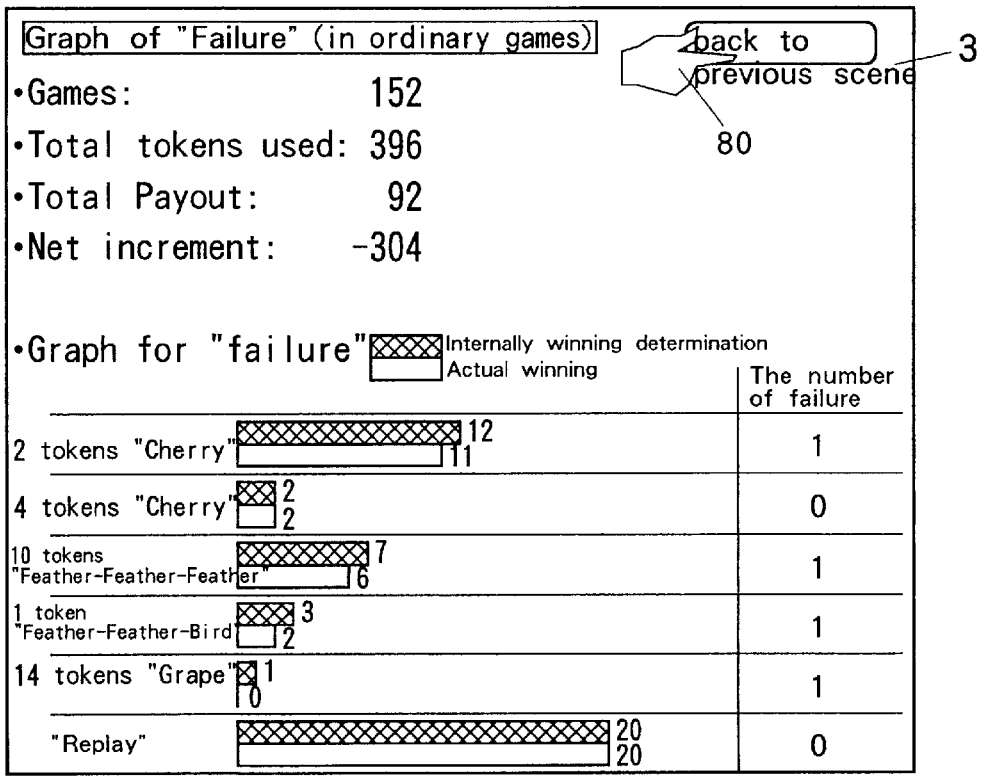
FIG. 26 is an explanatory view for indication of graph of "Failure" (in ordinary games) in the games results indication.

As seen in FIG. 26, graph of "Failure" (in ordinary games) which is shown when the Point Pf corresponding to the games results indication is 8 or more, reference value, includes total games, total tokens used, total payoff, net increment (difference between total tokens used and total payoff), and a table showing the number of internal winning determination, the number of winning, and the number of failure of specific winning styles.

Figure 27A:
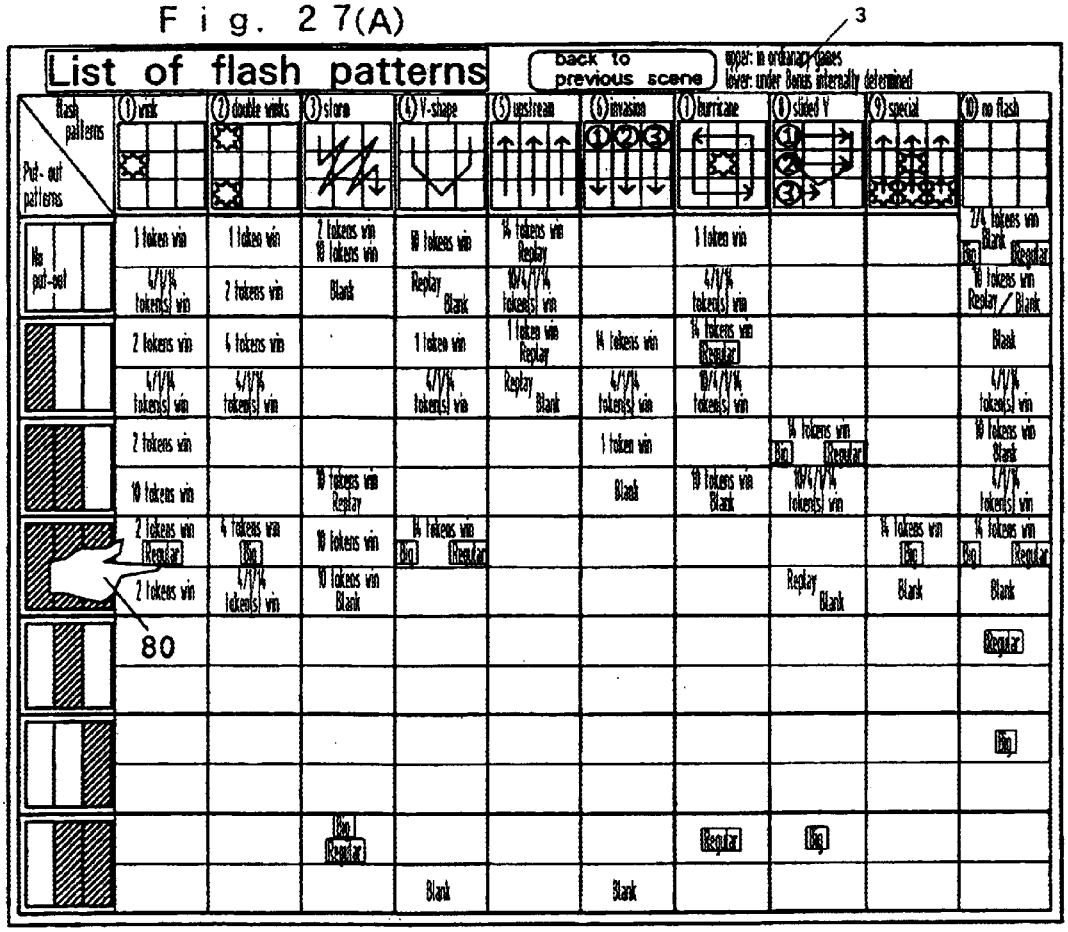
FIG. 27 is an explanatory view for indication of a list of flash patterns in the games results indication.
Figure 27B:
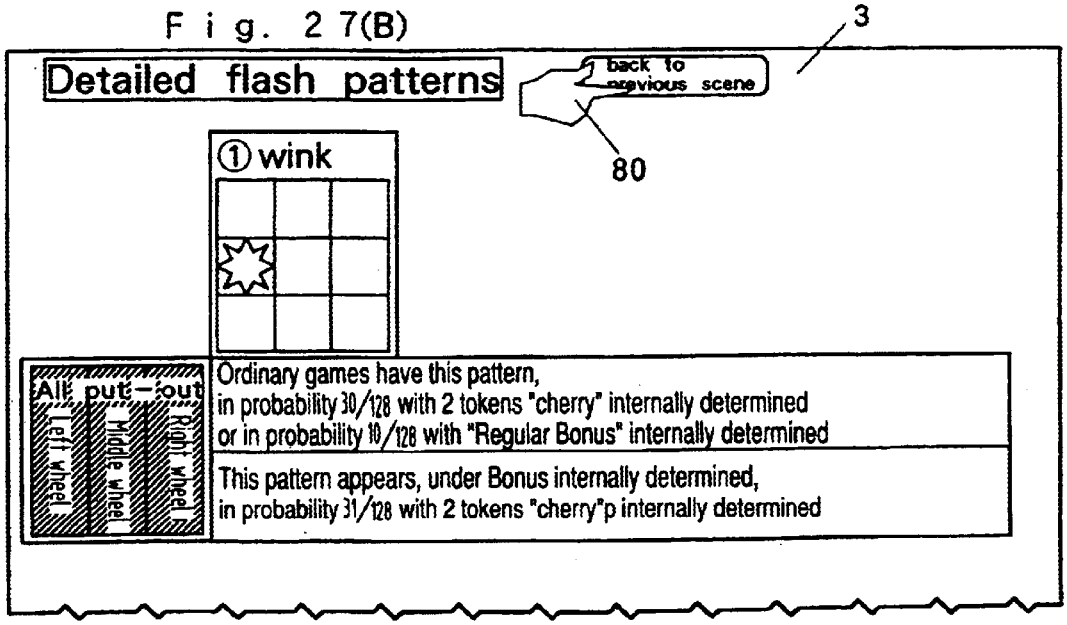

As shown in FIG. 27, list of flash patterns which is shown when the Points Pf is 10 or more shows 10 kinds of patterns of flashing on and off of lamps arranged in three rows and three lines behind the wheels immediately after all the wheels 4L, 4C, 4R have stopped, and 7 patterns of going out of the lamps in association with stopping of the wheels 4L, 4C, 4R, the patterns being arranged on a matrix, showing correlation between combination of those patterns and possibly appearing winning styles. The cursor 80 is set on the matrix and the decision button 85 is depressed, detailed explanation as FIG. 27(B) will be shown. The flash patterns may be combined with presence or none and kinds of sounds for a previous notice generated at the instant of the start lever 6 being tapped for providing a further minute informing patters.

Figure 28:
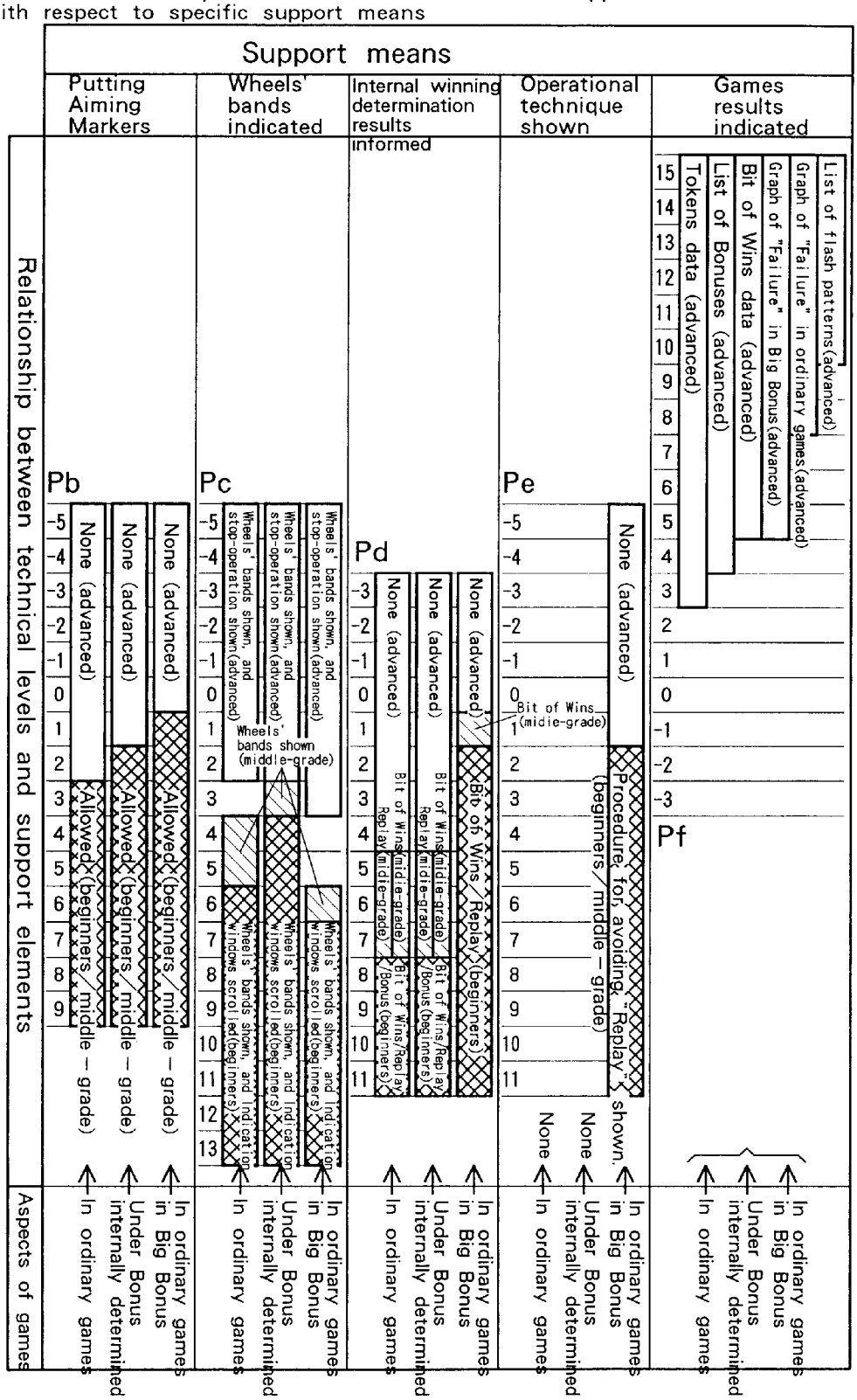
FIG. 28 is a table showing correlation between technical levels and support elements with respect to specific support means.
Figure 29:
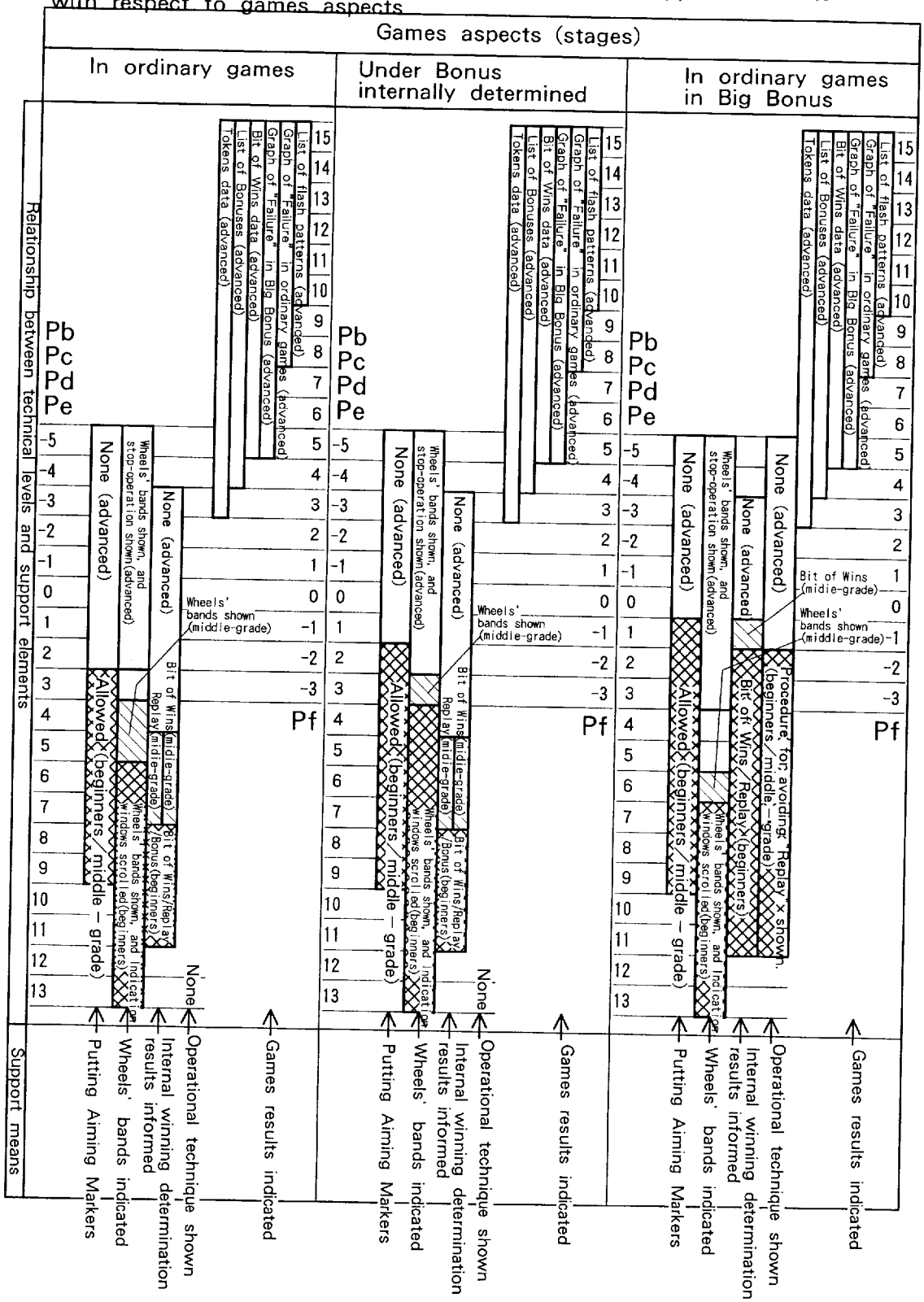
FIG. 29 is a table showing correlation between technical levels and support elements with respect to specific games aspects.

FIG. 28 shows correlation between technical levels as advanced, middle and beginner level and specific support elements orderly stepwise providing more careful and kind supports correspondingly to specific technical levels with respect to each support means. FIG. 29 is a modification (featuring specific aspects of the games) of the table of FIG. 28. As seen in FIGS. 28 and 29, suitable supports are applied correspondingly to specific technical levels in each support means and at specific aspects of the game. The support means do not need to be used necessarily entirely, i.e., may be used solely or in combination freely.

Figure 30:
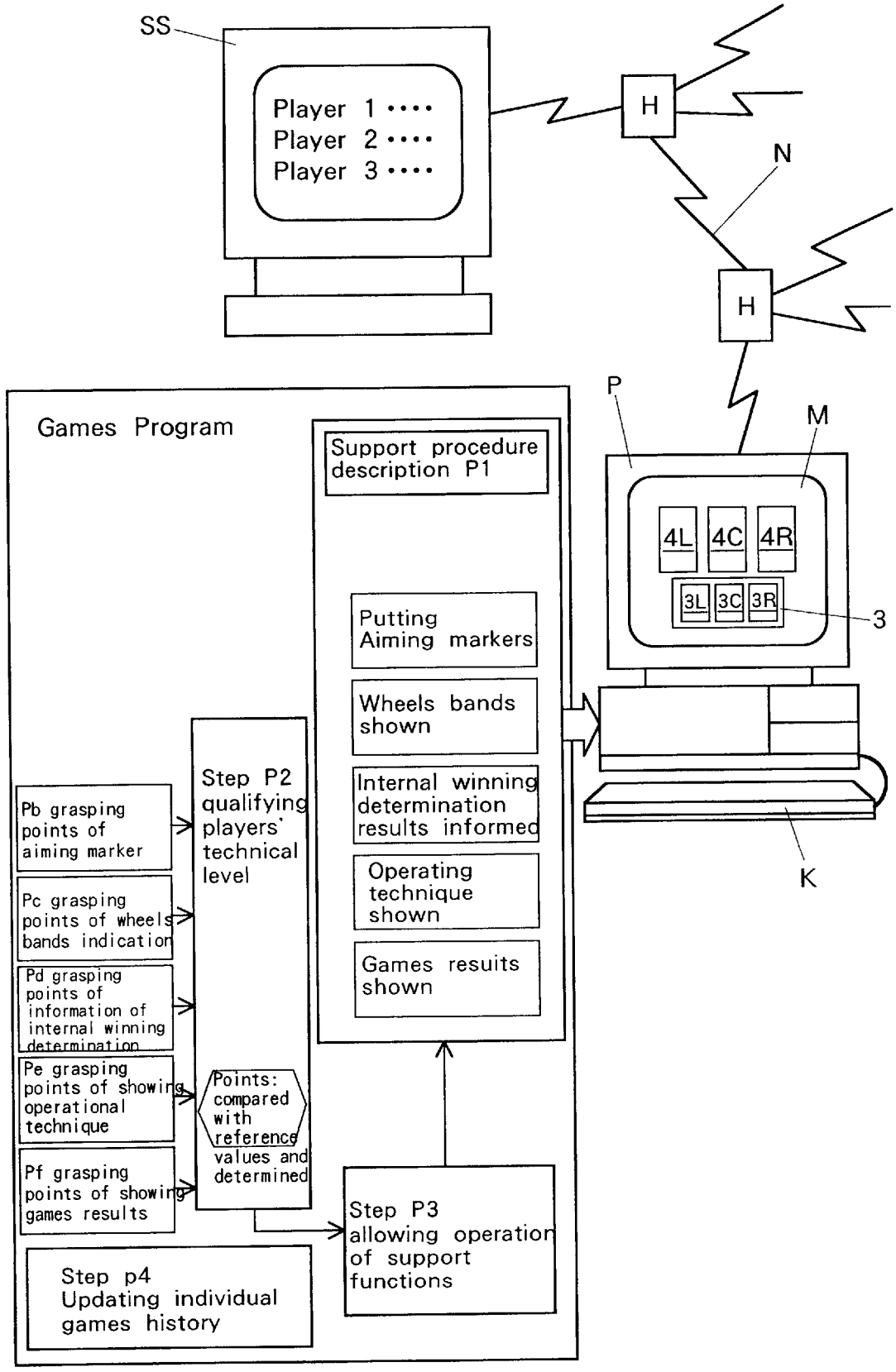
FIG. 30 is an explanatory view for structure of a second embodiment of the game program.

FIG. 30 shows a structure of program related to a second embodiment of a simulation game memorized in a medium such as a compact disc or ROM cartridge readable by a computer. The program includes a support procedure description P1 describing procedures of such support functions for favouring players and supporting them correspondingly to their technical levels as aiming markers setting, wheels bands indication, internal winning determination results informing, operational technique showing and games results indication. Contents of the supports are similarly to the foregoing.

Players input membership ID (in place of membership cards) from a keyboard K or the like of their personal computer P, and call up a server SS managing a game parlor on the internet N. H is a host computer of a service provider, etc. The technical level qualifying step P2 on the game program is used by the player to grasps updated points values Pb, Pc, Pd, Pe, Pf of specific items on the basis of player'games history read from the server SS, and qualifies technical levels as advanced, middle, beginner level on the basis of comparison between the points values and reference values.

The allowing step P3 for actuation of support functions on the game program is used by the player to decide acceptance or none of actuation of the support functions on the basis of the qualified technical levels. Upon ending the game, an updating step P4 for individual games history on the game program is used by the player to transmit games results of this time to the server SS and update the player'individual games history. The main wheels 4L, 4C, 4R and simulated wheels 3L, 3C, 3R on the image display device 3 are shown on the image monitor M of the personal computer P. The keyboard K provides the start lever, stop buttons, etc.

Figure 31:
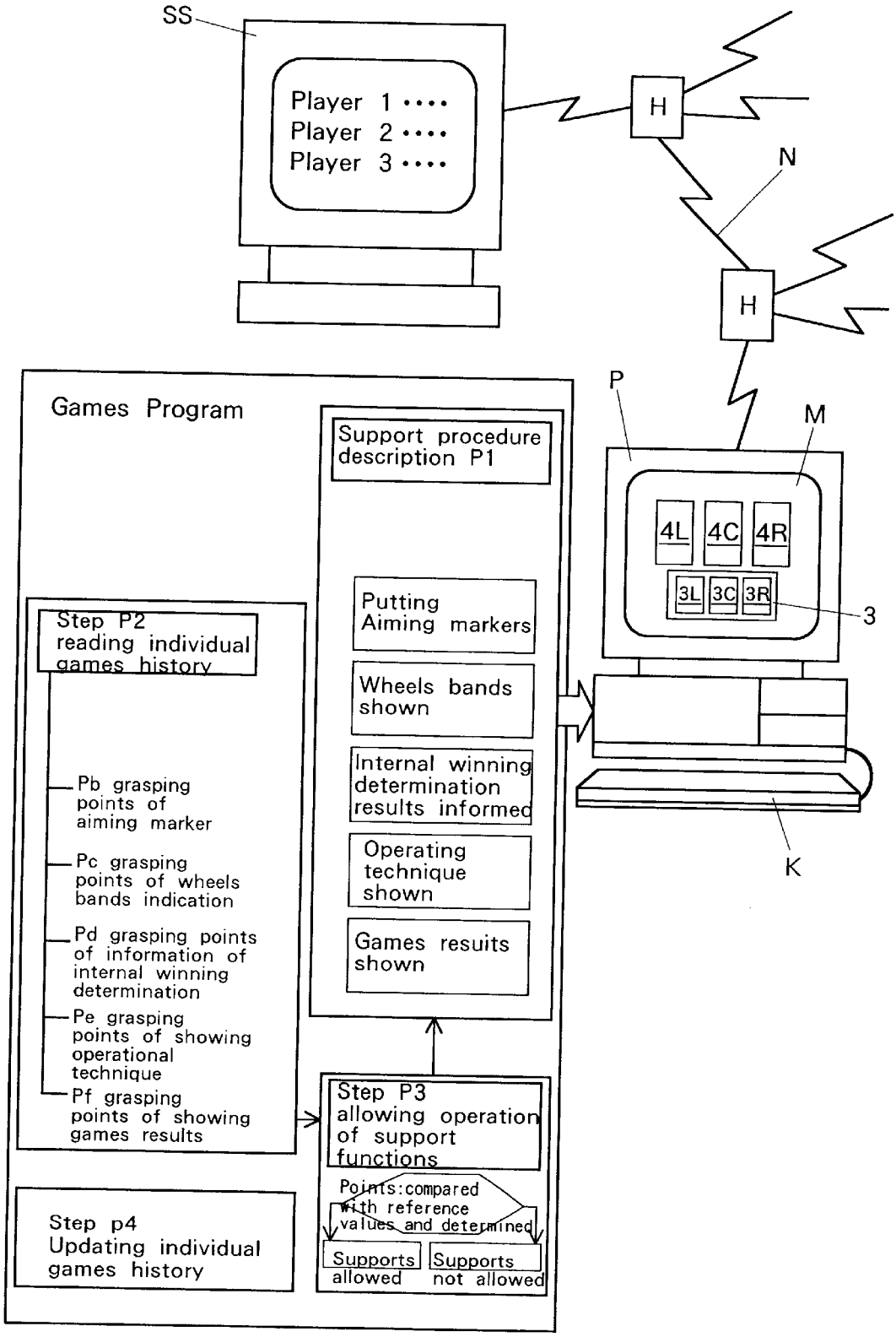
FIG. 31 is an explanatory view for structure of a modified example of the second embodiment of the game program.

FIG. 31 shows another example of a structure of program of a simulation game memorized in a medium such as a compact disc or ROM cartridge readable by a computer. The program includes, similarly to FIG. 30, a support procedure description P1 describing procedures of such support functions for favouring players as aiming markers setting, wheels bands indication, internal winning determination results informing, operational technique showing and games results indication.

Players input membership ID (in place of membership cards) from a keyboard K or the like of their personal computer P, and call up a server SS on the internet N. The individual games history reading step P2 on the game program is used by the player to read the player's game history from the server SS to grasp updated points values Pb, Pc, Pd, Pe, Pf of specific support elements.

The allowing step P3 for actuation of support functions on the game program is used by the player to decide acceptance or none of actuation of the support functions on the basis of comparison between the points values and reference values. Upon ending the game, an updating step P4 for individual games history on the game program is used by the player to transmit games results of this time to the server SS and update the player's individual games history.

FIGS. 32 to 41 show a third embodiment of a game device wherein technical levels of players are qualified in view of failures in winning the winning styles in ordinary games other than Big Bonus, beginner players having much failure in winning are given kind and careful support to save their disadvantage to some extent.

Figure 32:
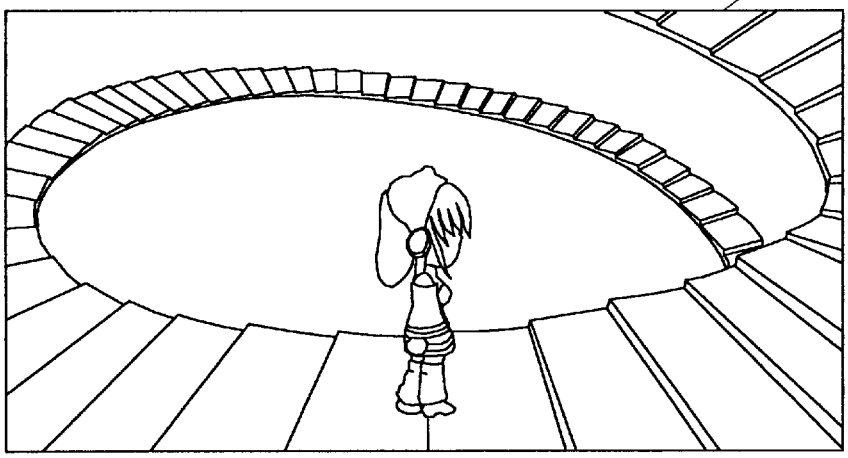
FIG. 32 is an explanatory view for a stand-by scene of the image display device in a third embodiment of the game device.
Figure 33:
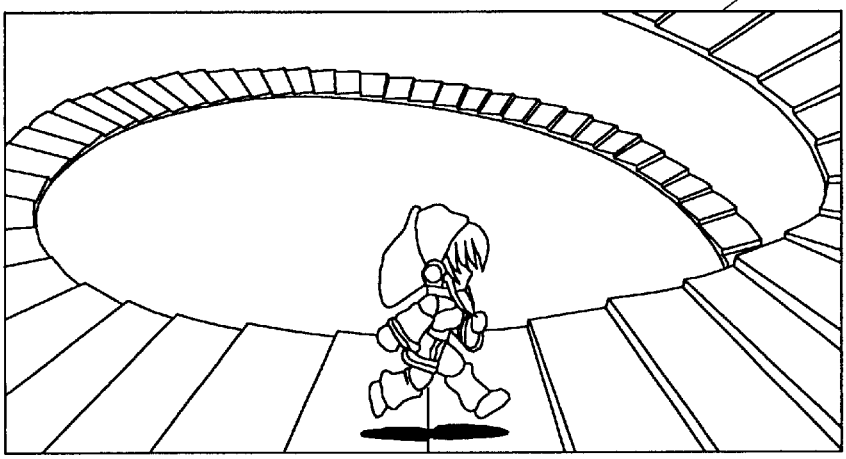
FIG. 33 is an explanatory view for a scene of the same display device after tokens used.

As seen in FIG. 32, the image display device 3 show a scene standing by before start of the game in which a heroine (girl) stands on a spiral. When coins are inserted directly or placed by a bet switch 5 from credit, the heroine moves upstairs as shown in FIG. 33. The background (not shown) behind the spiral maybe classified as "woods" a lowest level 1 for beginners, "Continent" a level 2 for those slightly advanced, "Sea of clouds" a level 3 for middle-grade players, and "Sky and stars" a level 4 for advanced players. When electric source is turn on, the game starts from the level 1 after a predetermined time from a preceding game.

According to the points addition table in FIG. 34 for specific levels, after stopping all the wheels, points for facilitating to improve levels depending upon achievement of winning styles corresponding to the internally determined flag are added for each level 1 to 4. By contrary, depending upon failure in winning corresponding to the internally determined flag, points are deducted to make level down.

As seen in the level-setting table in FIG. 35, the cumulative points 50 or less are level 1 for beginners, 51 to 100 level 2 for slightly advanced, 101 to 150 level 3 for middle-grade, and 151 or more level 4 for advanced players.

Upon turning on the source or after a predetermined time from a preceding game, an initial point is zero.

Figure 36:
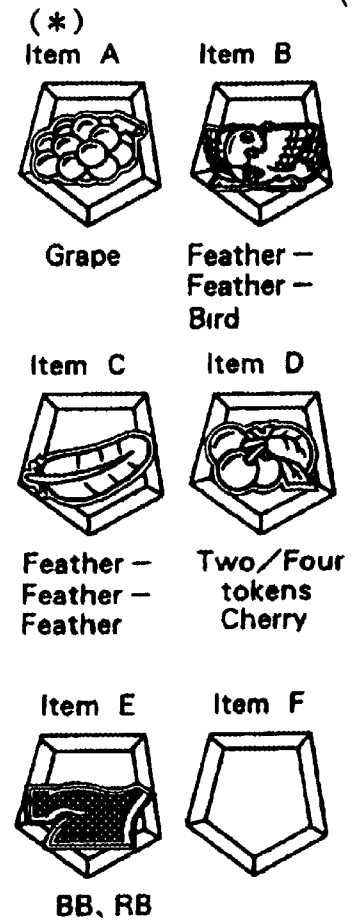
FIG. 36 is a table for selecting informing features for specific levels.

As seen in the table for selection of the informing features for specific levels in FIG. 36, at the level 4 for advanced players, the whole extent 128 of random numbers 0 to 127 obtain ed by use of R resister of a microcomputer CPU is allocated in a section of no informing, so that an internally determined flag is not informed in a next game. At levels 1 to 3, internally determined flags in a predetermined feature is informed for each level on the image display device 3 according to predetermined allocation sections including random numbers for selection and informing features correspondingly to the internally determined flag. The tables shown in FIGS. 34 to 36 are managed on the ROM of the control device in FIG. 5.

The bearer carrying the informing appears at the levels 1 to 3. As seen in FIG. 37, in level 1 for the absolute beginners, a matured large bearer giving impression as superior in leadership corresponding to a kind informing with high reliability is used, in level 2 used is a middle-sized child corresponding to the informing of slightly lowered reliability, and in level 3 for middle grade a small infant corresponding to the informing made not so frequently with lowered reliability.

Items of informing is handed over by the bearer to the heroine. Among the shield-shaped Items shown in FIG. 36, A includes Grape corresponding to the winning style "Grape", B a "Bird" corresponding to "Feather-Feather-Bird", C a Feather to "Feather-Feather-Feather", D a Cherry to two or four coins Cherry, E a Red Seven to Big or Regular Bonus, kinds of internally determined flags being capable of being guessed from the items. F is commonly used for internally determined flag having a shield only.

Figure 38:
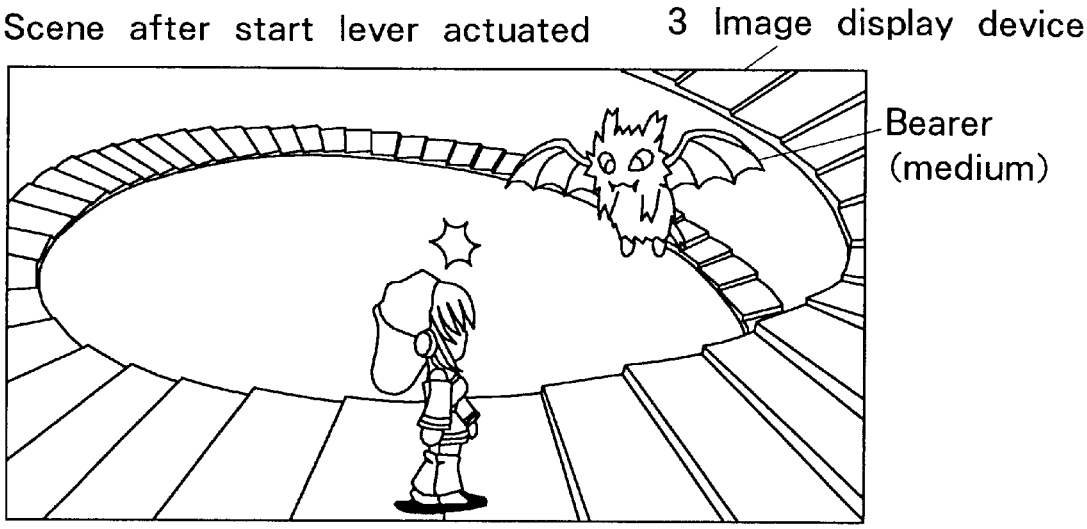
FIG. 38 is an explanatory view for a scene, of the image display device, after operation of the start lever.

When points in a preceding game is 51 to 100 at level 2, and the start lever 6 is operated this time to cause an internally determined flag of one-coin "Feather-Feather-Bird" is formed from internal winning determination, and the item B corresponding to the one coin "Feather-Feather-Bird" is selected by allocating-selection with random number selection. Simultaneously with or slightly delayed from start of rotation of the wheels, as shown in FIG. 38, the middle-sized, child bearer appears with winging.

Figure 39:
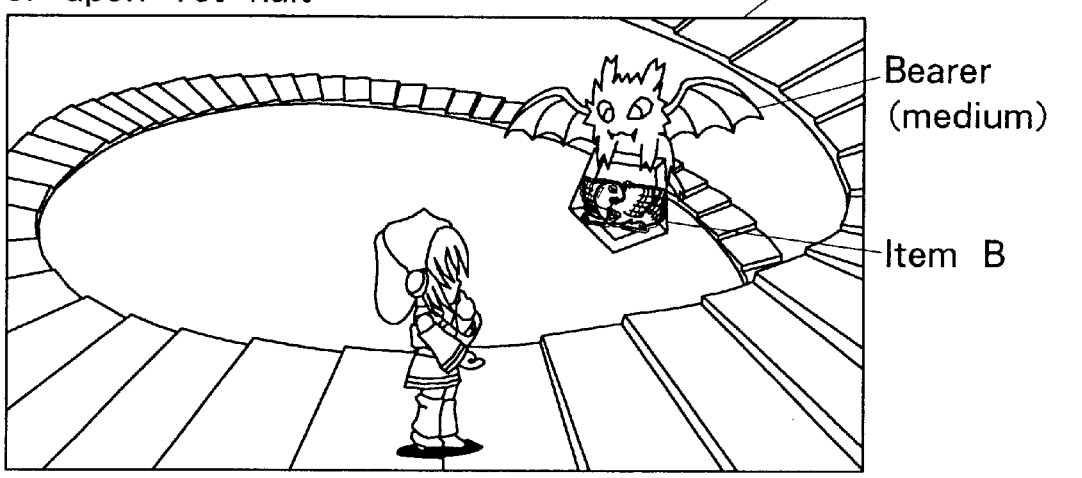
FIG. 39 is an explanatory view for a scene of the image display device upon first halt.
Figure 40:
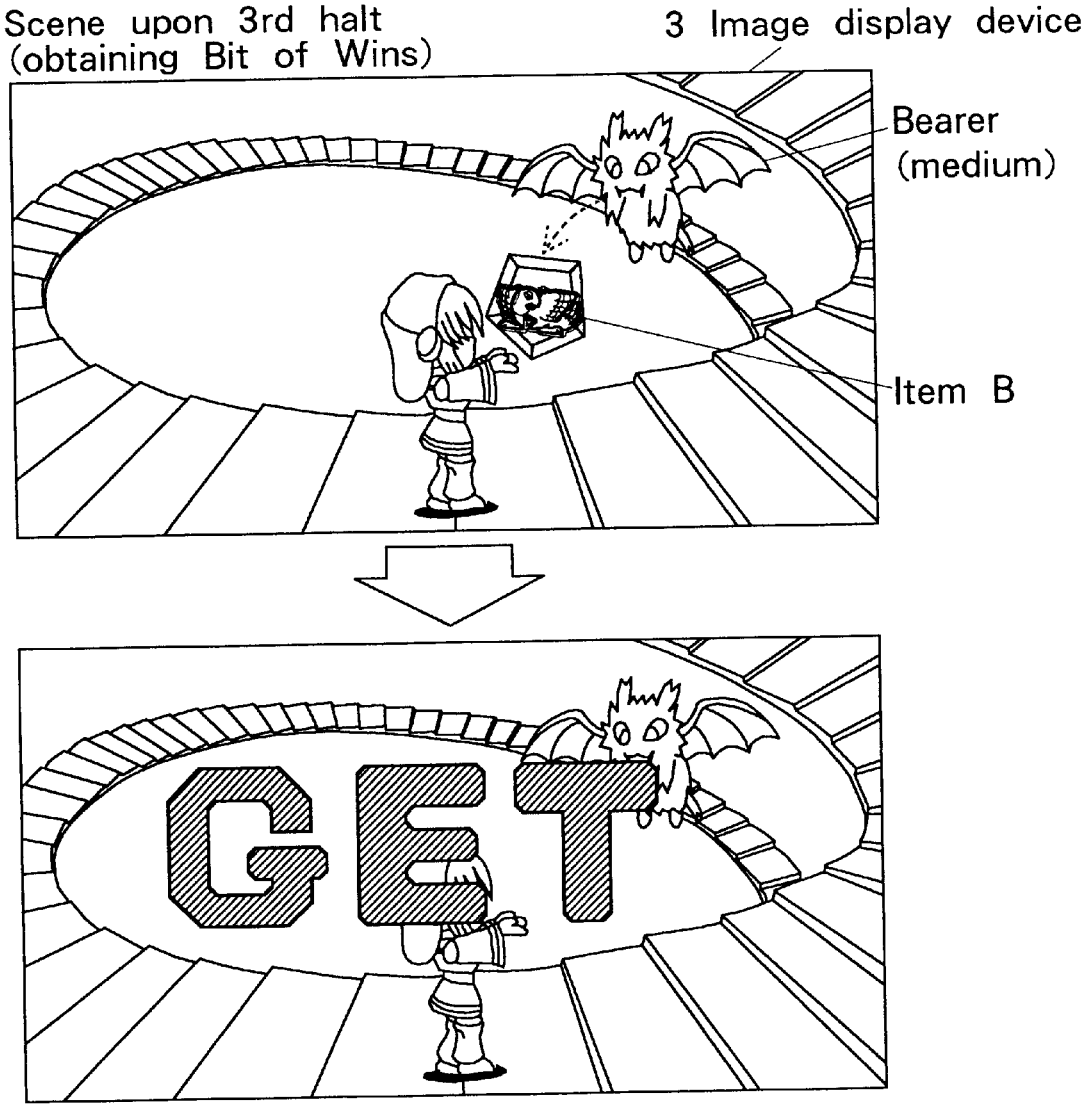
FIG. 40 is an explanatory view for a scene, upon winning Bit of Wins, of the image display device on third halt.

Consequently, or, upon a first halt at which any stop button 4L, 4C, 4R has been pushed, as shown in FIG. 39, the bearer is about to hand the item B over the heroine. And as seen in FIG. 40, upon a third halt when the last stop button is operated, in case that "Feather-Feather-Bird" are aligned on the effective winning line and winning can be achieved, the bearer throws the item B to the girl and the characters GET appears. Points are added by 10 and updated as seen in FIG. 34.

Figure 41:
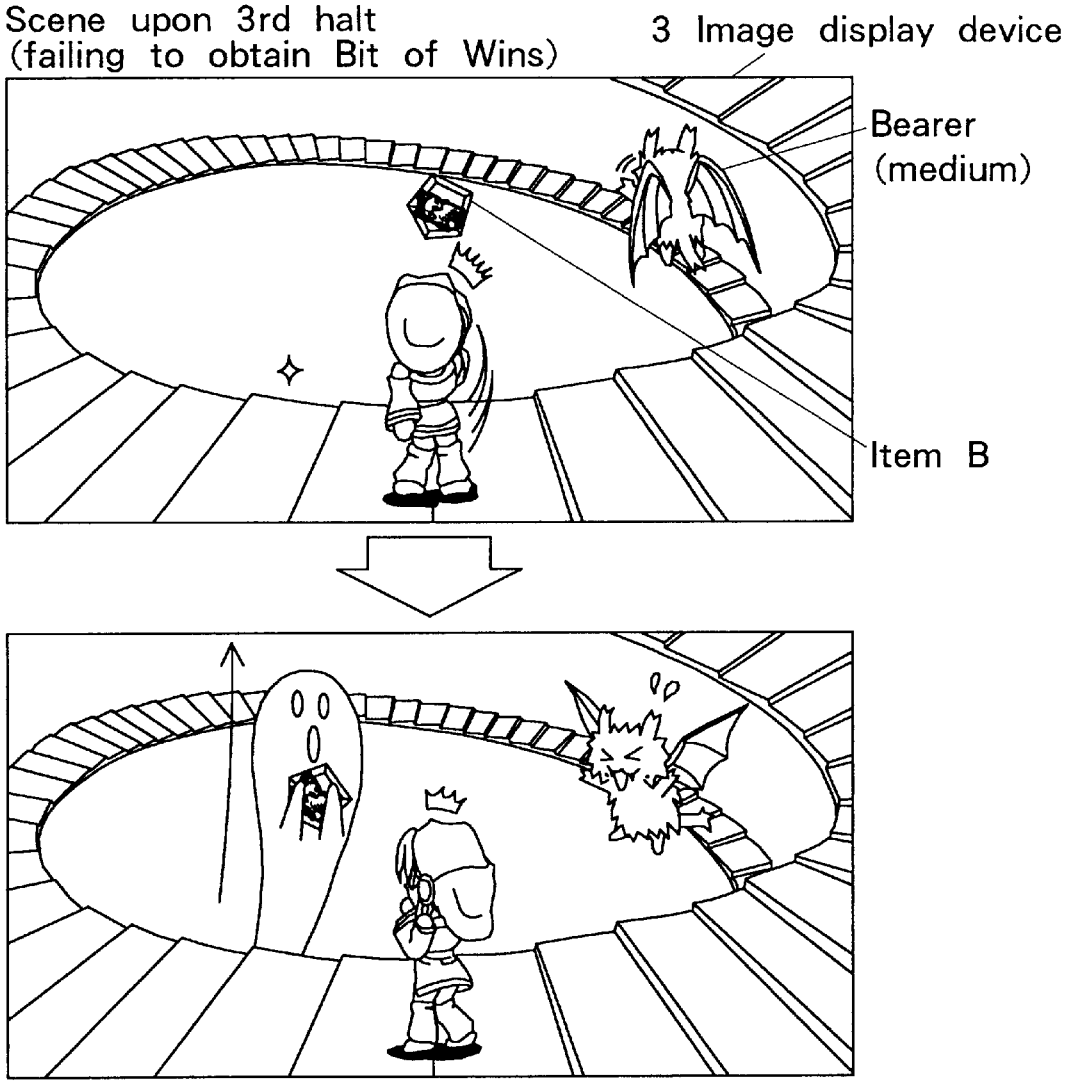
FIG. 41 is an explanatory view for a scene, upon failure in winning, of the image display device on the third halt.

If poor in operating timing of the stop button and "Feather-Feather-Bird" is not achieved on the winning line to fail to win the wins, the bearer throws the item B to the midst of the spiral and a ghost takes the item B and disappears as shown in FIG. 41. In this case, points are deducted by two and updated as seen in FIG. 34.

The exemplified animation pictures are almost similar in levels 1 to 3 except size of the bearer. In the level 1 for the beginners, the internally determined winning styles of Bit of Wins and the item completely correspond to each other, but, bonus flag of Big (BB) or Regular (RB) bonuses are not to be informed as the case of blank. If no informing is carried out, aiming "Red Seven" will do, which can be easily understood. BB and RB may be subjected to the informing.

In level 2 for the slightly advanced beginners, when any internally determined flag is achieved, it is inevitably informed, and the internally determined flag and the item necessarily correspond to each other, but there would be false informing wherein any item not corresponding to the internally determined flag would be informed. In the level 3 for middle-grade, the item F commonly used for the internally determined flag appears at a lower frequency, so that kinds of the internally determined flag cannot be perceived. In level 4 for advanced players, there appears no bearer and items, informing the internally determined winning styles are not at all carried out, so that they should play relying on DDT method and the arrangement of designs being about to become winning.

In the above feature, two and four coins Cherry are informed by use of a common item D but alternatively may be separately informed with respective items, for example, a shield having a three-fruits Cherry as item D for two coins Cherry and two sets of three-fruits Cherry for four coins one. Bonus may be similarly dealt, for example, BB may be informed with a shield having Red Seven as item E and RB with that having BAR. Also, Replay may be included in the internally determined winning styles subjected to informing at each level.

Accordingly, beginners who have much failure in winning the wins and be at lower level could be given kind informing at higher reliability of the internally determined flag and of what designs to be aimed at with pushing the stop button. Hence, the beginners apt to fail to win Bit of Wins, and slightly advanced beginners can be assisted properly to save their disadvantage in the game to some extent.

When the item D of a shield with "Cherry" appears in level 1, it is understood that Cherry (code numbers 9 and 20) arranged at an angular interval of about 180 degrees on the left-hand wheel 4L is to be stopped in the frame of the indication window 40L within a range of allowed number of designs for drawing-assist. By contrary, when the stopping operation is performed in a dead timing within a few designs after Cherry (No. 9 or 20) passing the lower winning line, it is understood that a coming Cherry away at an angular interval of about 180 degrees (Cherry No. 20 following No. 9 is positioned backward on an eleventh design, and Cherry No. 9 following No. 20 on an tenth design) cannot be drawn, and stopping operation in this timing should not be made.

When the item C of a shield with "Feather" in level 1, it is understood that stopping operation may be at random or unintentionally for all the wheels since many "Feather" designs dispersed on the wheels can be aligned on the winning line thanks to the drawing-assist. When the item B of a shield with "Bird", it is understood that a group of "Bird", "Feather" and "Bird" (code numbers 11, 12, 13) is to be aimed at on the right-hand wheel 4R.

As seen in the table in FIG. 34, the points addition from the lowest level 1 to the level 2 are set to be generally higher over the internally determined flags, and points deduction from the highest level 4 to the second high level 3 are made higher generally. Hence, beginners and slight advanced ones are given kind and careful support (to be kind of slightly over-protected) in a certain term but not long or forever. Advanced players when become low in skill can be given the support through the informing of the internally determined winning styles. Hence, the invention can apply the support fairly and properly to all of the beginners and advanced players correspondingly to their skills.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

I claim:

1. A game device having a support means favouring players wherein the support means supports players' technical intervention without changing fundamental specification of the game device; a technical level qualifying means for qualifying players' technical levels; and a support allowing means which allows actuation of the support means on the basis of the qualified technical levels, wherein the definition of "without changing fundamental specification of the game device" does not include adjustment of wheel rotation numbers and adjustment of a number of wheel-slide designs.

2. A game device as set forth in claim 1, wherein the support means is provided with a plural steps of support elements separated correspondingly to difference in technical levels, and also with a supports-choosing means for choosing, on the basis of qualified high or low technical levels, a support element to be allowed of actuation.

3. A game device as set forth in claim 2 comprising plural lines of a changeable indication means which changeably indicates a plurality of designs or pictures including those corresponding to Bonus, and a stop means for stopping a predetermined design or picture of each line of the changeable indication means on a winning line correspondingly to an operation timing, wherein a technical level is qualified into a lower rank whenever the number of games that the Bonus designs are not aligned on the winning lines to win no Bonus becomes larger after a first game in which Bonus is internally determined and Bonus-flag is achieved, and there is chosen a support element enabling the Bonus designs to be readily aligned on the winning lines whenever the technical level is qualified in the lower rank.

4. A game device as set forth in claim 2 comprising plural lines of changeable indication means, which changeably indicates a plurality of designs or pictures including those for Bonus for providing a winning style of Big Bonus that is a combination of at least one effective ordinary game in limited times and at least one Regular Bonus in limited times and ends depending on any limitations; and a stop means for stopping a predetermined design or picture of each line of the changeable indication means on a winning line correspondingly to an operation timing; wherein a technical level is qualified into a lower rank whenever benefit given in the middle of Big Bonus is smaller, and there is chosen a support element facilitating increase of benefit to be obtained whenever the technical level is qualified in the lower rank.

5. A game device as set forth in claim 2 comprising plural lines of a changeable indication means which changeably indicates a plurality of designs or pictures including those for Bonus and for Bit of Wins; a stop means for stopping a predetermined design or picture of each line of the changeable indication means on a winning line correspondingly to an operation timing, wherein a technical level is qualified into a lower rank whenever the number of games is larger in the time from the end of previous Bonus to that Bonus is achieved again, and there is chosen a support element enabling the winning designs to be readily aligned on the winning lines whenever the technical level is qualified in the lower rank.

6. A game device as set forth in claim 2 comprising plural lines of changeable indication means which changeably indicates a plural designs or picture including those for Bonus and for Bit of Wins; a stop means for stopping a predetermined design or picture of each line of the changeable indication means on a winning line correspondingly to an operation timing, wherein a technical level is qualified into a lower rank whenever failure in winning is much, and there is chosen a support element enabling the winning designs to be readily aligned on the winning lines whenever the technical level is qualified in the lower rank.

7. A game device as set forth in claim 2, wherein the technical level qualifying means qualifies technical levels correspondingly to specific values of points recognized from records in an individual games history recording means for specific players.

8. A medium storing or memorizing a game program for controlling a game device and readable by a computer, the medium comprising a support procedure description describing a disposing procedure for support functions favouring players, the support functions supporting player's technical intervention without changing fundamental specification of the game device, the game program causing the computer to fulfill a game support method having a technical level qualifying step qualifying technical levels of players and an allowing step allowing actuation of the support functions on the basis of the qualified technical levels, wherein the definition of "without changing fundamental specification of the game device" does not include adjustment of wheel rotation numbers and adjustment of a number of wheel-slide designs.

9. A game device comprising a support means favouring players, wherein the support means supports players' technical intervention without changing fundamental specification of the game device, and there is provided a support allowing means for allowing actuation of the support means on the basis of records in an individual games history recording means for specific players, wherein the definition of "without changing fundamental specification of the game device" does not include adjustment of wheel rotation numbers and adjustment of a number of wheel-slide designs.

10. A game device as set forth in claim 9 wherein the support allowing means allows actuation of the support means on the basis of comparison between reference values and specific values of points recognized from the records in the individual games history recording means.

11. A game device as set forth in claim 10 wherein the support means includes plural kinds of support elements showing separate support functions in different features, and said specific points values and said reference values are classified for respective support elements.

12. A game device as set forth in claim 10 wherein the support means includes plural steps of subdivided support elements providing relative importance in contents of support, and said reference values for said specific points values are set for respective subdivided support elements.

13. A game device as set forth in claim 10 wherein the reference values for the specific points values are set in different values correspondingly to differences in aspects of the game.

14. A game device as set forth in claim 10 wherein the reference values for the specific points values are changeable in setting from the outside.

15. A game device as set forth in claim 10 wherein the support means is provided for beginners to be useful for mitigating difficulty in the game.

16. A game device as set forth in claim 15 further comprising plural lines of changeable indication means which makes changeable indication on condition of insertion or use of value-mediums; a stop means for stopping a predetermined design on each line of the changeable indication means on a winning line correspondingly to an operation timing; pay-out or payoff means for paying out a predetermined number of the value-mediums upon achievement of winning; and an updating means which updates the records in the individual games history recording means in a manner of causing the specific points values corresponding to the support means for the beginners to be away from the reference values when a gain-ratio that is a ratio between the value-mediums used and the value-mediums paid out is over a predetermined value.

17. A game device as set forth in claim 15 comprising plural lines of changeable indication means, which changeably indicates a plurality of designs or pictures including those for Bonus for providing a winning style of Big Bonus that is a combination of at least one effective ordinary game in limited times and at least one Regular Bonus in limited times and ends depending on any limitations; a stop means for stopping a predetermined design or picture of each line of the changeable indication means on a winning line correspondingly to an operation timing; and an updating means which updates the records in the individual games history recording means in a manner of causing said specific points values corresponding to the support means for the beginners to be away from the reference values when an average obtained benefit in Big Bonus is over a predetermined value.

18. A game device as set forth in claim 15, further comprising an updating means which updates the records in the individual games history recording means in a manner of causing the specific points values for allowing actuation of the support means to be near the reference values when the number of achievement of Big Bonus is over a predetermined value.

19. A game device as set forth in claim 10 wherein the support means is provided for advanced players to be useful for estimation of the game.

20. A game device as set forth in claim 19 further comprising plural lines of changeable indication means which makes changeable indication on condition of insertion or use of value-mediums; a stop means for stopping a predetermined design on each line of the changeable indication means on a winning line correspondingly to an operation timing; pay-out or payoff means for paying out a predetermined number of the value-mediums upon achievement of winning; and an updating means which updates the records in the individual games history recording means in a manner of causing the specific points values corresponding to the support means for the advanced players to be near the reference values when a gain-ratio that is a ratio between the value-mediums used and the value-mediums paid out is over a predetermined value.

21. A game device as set forth in claim 19 comprising plural lines of changeable indication means, which changeably indicates a plurality of designs or pictures including those for Bonus for providing a winning style of Big Bonus that is a combination of at least one effective ordinary game in limited times and at least one Regular Bonus in limited times and ends depending on any limitations; a stop means for stopping a predetermined design or picture of each line of the changeable indication means on a winning line correspondingly to an operation timing; and an updating means which updates the records in the individual games history recording means in a manner of causing said specific points values corresponding to the support means for the advanced players to be near the reference values when an average obtained benefit in Big Bonus is over a predetermined value.

22. A game device as set forth in claim 19, further comprising an updating means which updates the records in the individual games history recording means in a manner of causing the specific points values for allowing actuation of the support means to be near the reference values when the number of achievement of Big Bonus is over a predetermined value.

23. A game device as set forth in claim 10 wherein the support means includes those for beginners useful for mitigating difficulty in the game and those for advanced players useful for estimation of the game.

24. A game device as set forth in claim 10 further comprising an updating means which updates the records in the individual games history recording means in a manner of causing the specific points values for allowing actuation of the support means to be near the reference values when an extent of use of the game is over a predetermined value.

25. A game device as set forth in claim 10 wherein recorded in the individual games history recording means is personal information which weights the specific points values for allowing actuation of the support means.

26. A medium storing or memorizing a game program for controlling a game device and readable by a computer, the medium comprising a support procedure description describing a disposing procedure for support functions favouring players, the support functions supporting players' technical intervention without changing fundamental specification of the game device, the game program causing the computer to fulfill a game support method having a reading step reading records in the individual games history for specific players, an allowing step allowing actuation of the support functions on the basis of the read individual games history, and an updating step updating the records in the individual games history upon end of the game, wherein the definition of "without changing fundamental specification of the game device" does not include adjustment of wheel rotation numbers and adjustment of a number of wheel-slide designs.

* * * * *